United States Patent [19]

Takano et al.

[11] Patent Number: 4,697,917

[45] Date of Patent: Oct. 6, 1987

[54] COPYING MACHINE

[75] Inventors: Yoshiaki Takano; Keichi Kinoshita, both of Toyokawa, Japan

[73] Assignee: Minolta Camera Kabushiki Kaisha, Osaka, Japan

[21] Appl. No.: 764,422

[22] Filed: Aug. 9, 1985

[30] Foreign Application Priority Data

Aug. 9, 1984 [JP] Japan ..... 59-167311
Jun. 12, 1985 [JP] Japan ..... 60-129058

[51] Int. Cl.[4] ..... G03G 15/04; G03G 21/00
[52] U.S. Cl. ..... 355/14 R; 355/56
[58] Field of Search ..... 355/3 R, 8, 14 R, 55, 355/56

[56] References Cited

U.S. PATENT DOCUMENTS 4,575,227 3/1986 Ito et al. ..... 355/56

*Primary Examiner*—Fred L. Braun
*Attorney, Agent, or Firm*—Price, Gess & Ubell

[57] ABSTRACT

A copying machine with a predetermined variable magnification range is capable of providing a wider range of magnification values. The copying magnification desired can be entered into the copying machine and if the desired magnification data is out of the predetermined range, the machine can automatically calculate the number of times that a copy must be made and can also determine the magnification ratio for each copy to produce the desired final magnification value. The number of times that the copying process must be repeated with the copying paper being used as an original for each process can be displayed to the operator.

31 Claims, 36 Drawing Figures

COPYING MACHINE

FIELD OF THE INVENTION

The present invention relates to a copying machine having a magnification control function.

BACKGROUND OF THE INVENTION

In conventional copying machines in which copying magnification is variable, there is a limit to the maximum and minimum magnification values.

In order to make a copy with a copy magnification over the maximum or minimum magnification values designated in the copying machine (referred to as available magnification limit hereinafter) an original is first copied with the limit magnification, then putting the magnified copy as a secondary original, thereby making another copy which is further magnified. Repeating this operation, a magnified copy with a nearly desired magnification over the limit magnification can be obtained. In the conventional copying machine, however, in making such a magnified copy, the operator must estimate a suitable magnification then set the estimated magnification in the copying machine in each copy, whereby the operation of setting the suitable magnification is much troublesome.

SUMMARY OF THE INVENTION

An essential object of the present invention is to provide a copying machine which is able to automatically calculate a necessary number of times for copy to obtain a copy with a desired magnification which is beyond the available magnification limit of the copying machine.

Another object of the present invention is to provide a copying machine which is able to automatically make a copy with a desired magnification which is out of the available magnification limit.

A further object of the present invention is to provide a copying machine which is able to automatically make a copy with a desired magnification which is out of the available magnification limit and each material which is a copy magnified from a source original can be transported to a predetermined position for being used as the original.

According to the present invention there is provided a copying machine with a variable magnification capability within a predetermined range of the magnification value which comprises;

means for entering copying magnification data including the magnification data out of the said predetermined range;

means for calculating a number of times for copying to obtain a copy with said entered magnification, when said entered magnification is out of the predetermined range, by repeating a copy operation of said number of times each time using an original which is a copied material magnified with a magnification within said predetermined range; and means for displaying said calculated number of times for the copy.

DETAILED DESCRIPTION OF PREFERRED EMBODIMENT

Figure 1:
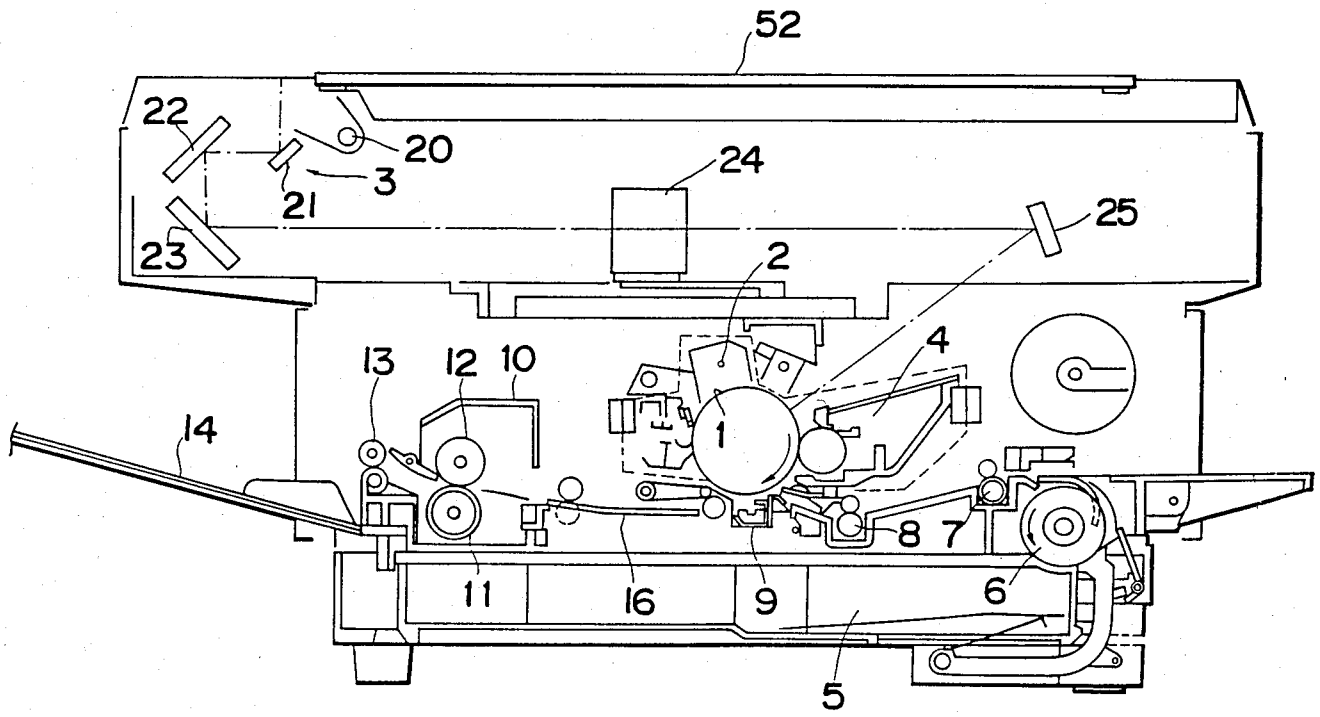
FIG. 1 is a schematic diagram showing an embodiment of a copying machine according to the present invention.

Referring to FIG. 1 showing an electrophotographic copying machine, there is provided a photoreceptor drum 1 disposed substantially at the central portion of the copying machine. The photoreceptor drum 1 can be rotated in the clockwise direction in FIG. 1 and is charged with a predetermined value by a corona charger 2. The photoreceptor drum 1 is exposed to a light image of an original placed on a platform 52 made of a transparent glass plate in the pattern of a slit when the original is scanned by an optical system 3. A potential image of static charge formed on the photoreceptor drum 1 is developed as a toner image by toner distributed by a developing device 4 of a brush type.

Copying papers are contained in a paper feeding cassette 5 and each of the papers is fed toward the photoreceptor drum by the rotation of a paper feeding roller 6 from the top of the piled papers. Each of the copying papers is reversed around the paper feeding roller 6 and in turn transported to the left in FIG. 1 by a pair of transport rollers 7, thereby being fed to an image transferring region through a pair of timing rollers 8. The copying paper is subjected to an electric field applied by a transfer charger 9 from below so that the toner image can be transferred to the copying paper from the drum 1. The copying paper is separated from the photoreceptor drum 1 and is transported to a fixing device 10 through a guide plate 16. The copying paper is heated by heat rollers 11 and 12 of the fixing device 10 so as to fix the toner image on the copying paper. Thereafter, the coping paper is discharged to a tray 14 from a pair of rollers 13.

The optical system 3 is provided so as to be moved below the platform 52 for scanning the original placed on the platform from below. The optical system 3 comprises a light source 20, a set of movable mirrors 21, 22 and 23, a lens 24, and a mirror 25. The light source 20 and the movable mirror 21 can be moved to the right in FIG. 1 at a speed v/m (wherein v is a peripheral speed of the photoreceptor drum 1, m is a magnification value) and the mirrors 22 and 23 can be moved to the right in FIG. 1 at a speed v/2m by a DC motor. It is noted that the speed v of the photoreceptor drum 1 is constant regardless of change of the magnification value. In changing the magnification value, the lens 24 is displaced along its light axis and the mirror 25 is displaced along the light path and also rotated by a predetermined angle.

In changing the magnification value it is necessary to set the scanning speed of the optical system 3 corresponding to the set magnification value and to displace the lens 24 and mirror 25 to the predetermined positions. As the scanning speed setting mechanism, the arrangement disclosed in U.S. Pat. No. 4,426,149 may be used. As the mechanism for setting the lens 24 and the mirror 25, the arrangement disclosed in U.S. patent application Ser. No. 596,824 filed on Apr. 3, 1984, now U.S. Pat. No. 4,571,064, may be used. The setting of the scanning speed and movement of the mirror are effected under the control of a microcomputer which may be of the type of control as disclosed in U.S. patent application Ser. No. 561,571 filed on Dec. 14, 1983 now U.S. Pat. No. 4,575,227. In the present embodiment, the magnification setting can be made by 1/1000 unit. As the way of inputting the necessary data for setting the desired magnification, the way of inputting the data used in the U.S. patent application Ser. No. 561,571 may be used. It is, however, noted that in U.S. patent application Ser. No. 561,571 the data out of the available magnification limit is rejected, but in the present invention such data also can be entered in the copying machine.

Figure 2:
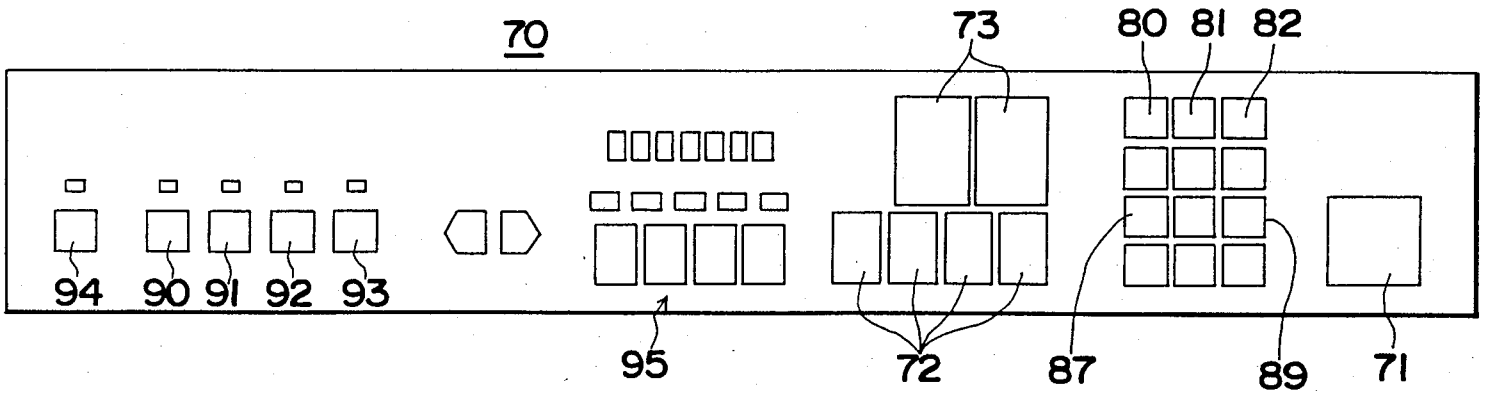
FIG. 2 is a top plan view of an operation panel used in the copying machine shown in FIG. 1.

FIG. 2 shows an arrangement of an operation panel used in the preferred embodiment of the copying machine according to the present invention. In the operation panel 70, there are provided a print key 71 for starting the copy, a digital display unit 72 for displaying various data in a digital form, another display unit 73 for displaying a number of copy, ten keys 80 to 89 each corresponding to the numeral 0 to 9, magnification selecting keys 90, 91, 92 and 93 for setting fixed magnification values, a magnification setting key 94 and a further display unit 95 of four digits for displaying the magnification value of the available magnification limit.

The magnification selecting keys 90, 91, 92 and 93 are respectively assigned to the respective copying magnification values which are preliminarily stored in corresponding memory locations so that a copy with one of the magnification values can be made upon operation of one of the magnification selecting keys 90 to 93. Such fixed magnification values may be designated at the time of forwarding from the factory corresponding to the requirement of the user of the copying machine or to the values which may be most frequently used. For example, for the domestic in Japan, such magnification values corresponding to the change of A4 to B5, B4 to A4, A3 to A4 or A4 to A3.

Figure 3:
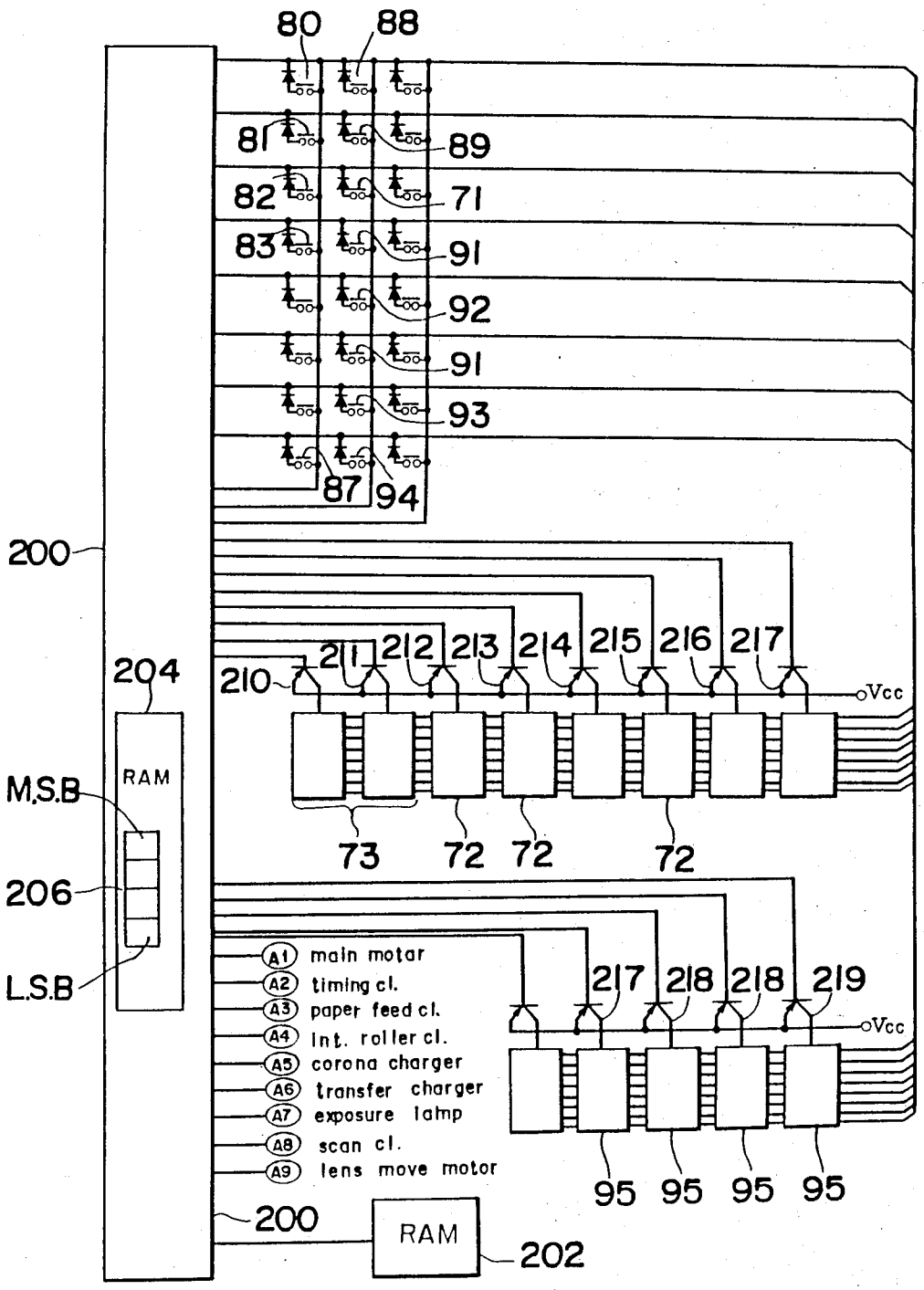
FIG. 3 is a schematic diagram showing a block diagram of a control device used in the copying machine shown in FIG. 1, FIGS. 4 through 11 are respectively flow charts showing the operation of the copying machine according to the present invention, FIGS. 12(*a*) and 12(*b*) are top plan views showing examples of the display according to the present invention.

The data of the magnification values within the available magnification limit may be stored in a RAM 202 (FIG. 3) provided in a CPU 200 made of a microcomputer and can be read out as desired.

The entered magnification value is displayed on the display unit 72. When a desired magnification value is entered to the copying machine, the control device determines whether the entered magnification is within the available magnification limit. Then with the entered magnification within the available magnification limit, the entered magnification is stored in the memory location 206. On the other hand, with the entered magnification out of the available magnification limit, the CPU 200 calculates the number of times of copying that are necessary for making the copy with the desired or entered magnification. The result of the calculation is stored both in the memory location for the number of times for copying (referred to as copy time memory location) and in the memory location for storing the magnification value. The necessary number of times for copying and the desired magnification are displayed in the display units 73 and 95.

The copying machine is operated under the control of the CPU 200 for making the necessary magnified copy based on the necessary number of times of copying and the data entered from the keys. In FIG. 3, 210 to 219 represent transistors for driving the display units 72 and 75 and 95.

The magnification storing memory locations 206 have the most significant position mh and the least significant position ml so as to store, for example, a three digit number below the decimal point with for effective digit numbers.

Figure 4:
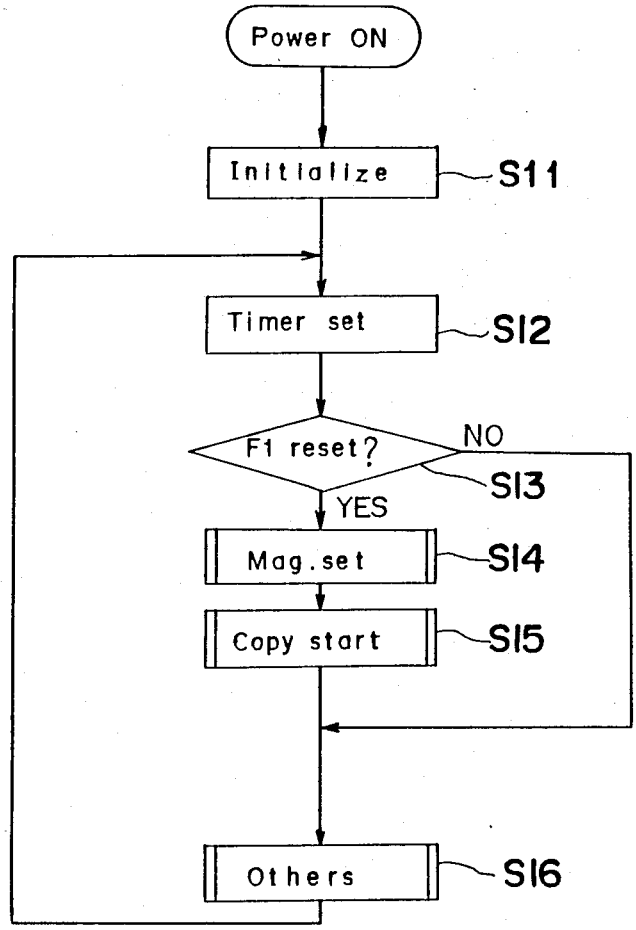

Referring to FIG. 4, showing the main copy routine of the CPU 200, upon application of the power, the CPU is initialized. The initialization includes to set the number of copies to 1, to return the scanner to its home position and so on.

In the step S12, a timer for setting the time length of the one routine of the CPU 200 is set.

In the step S13, it is determined whether the copy is busy by a busy flag F1. In case of a busy state, the process goes to the step S16.

In case of a not busy state, the process goes to the step S14, wherein the data entered by the ten keys 80 to 89 is taken in the CPU 200 as the entered magnification and the data is set in the CPU 200 as the magnification value.

In the step S15 the copy operation is set about in the stand-by state by detecting the state of the print key 71. The details of the steps S14 and S15 are described hereinafter.

The step S16 is provided for various procedures such as an input process relating to the ten keys and a clear stop key c/s, a count down process of the number of copy, display process of the magnification value, the control of the optical system for the magnification, and the control of copy process.

Figure 5A:
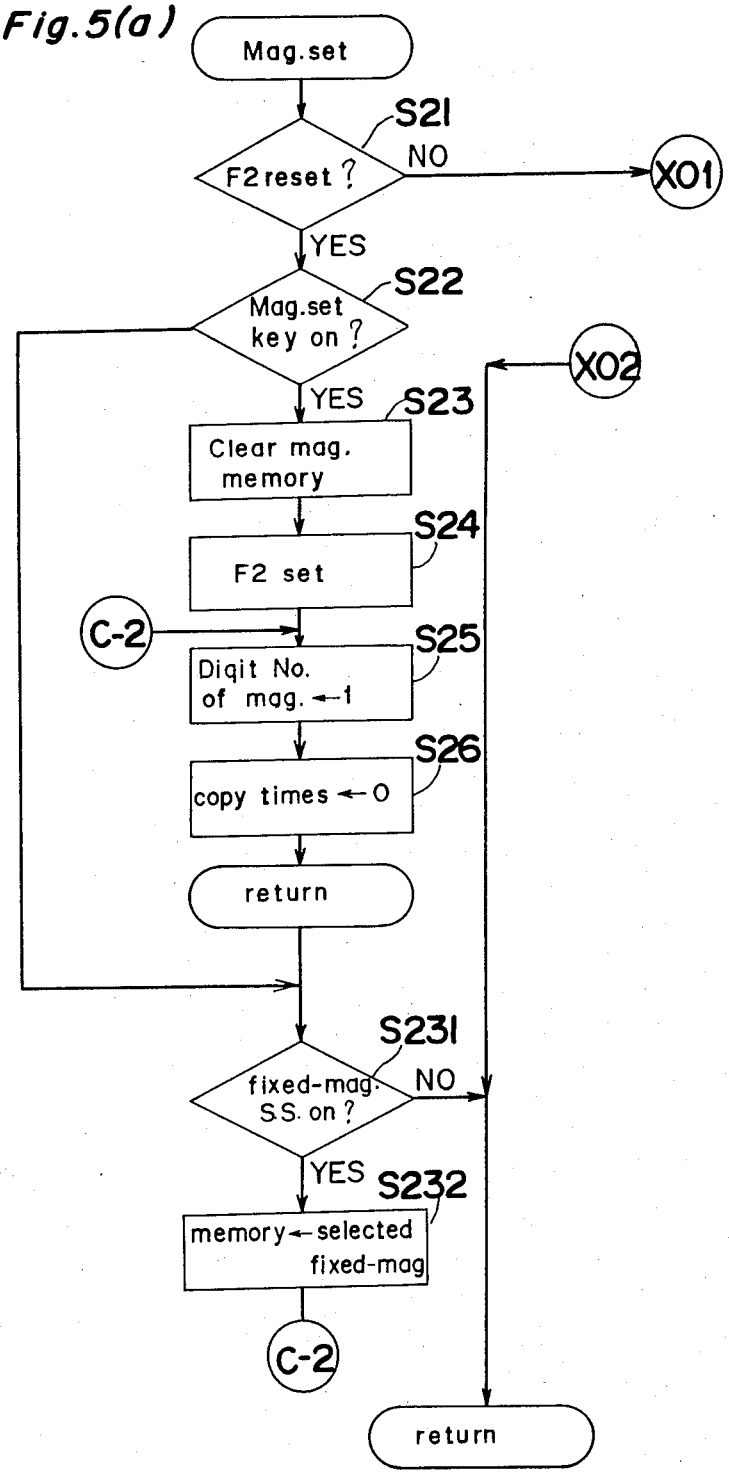
Figure 5B:
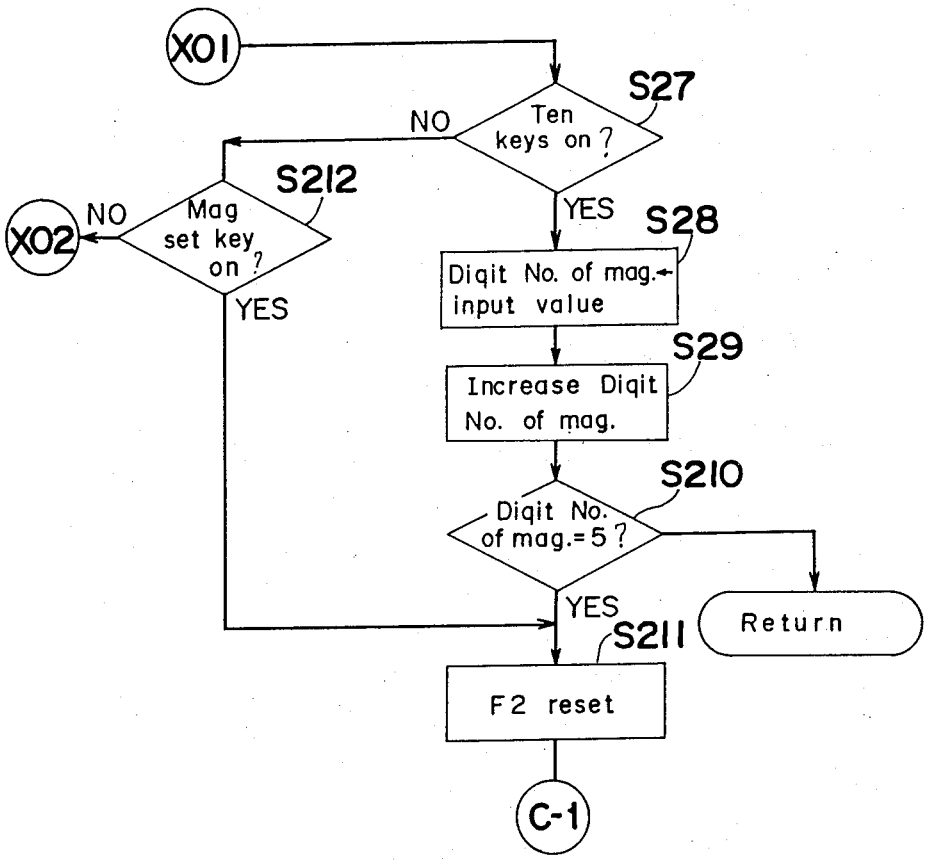

FIG. 5 shows a copy magnification set routine indicated as the step S14 in FIG. 4.

In order to make the magnified copy, it is necessary to enter the magnification data by the operation of the keys on the operation panel 70. In the operation of entering the magnification value, either one of the fixed magnification value or optional magnification value must be entered. The fixed magnification value is entered by the keys 90, 91, 92 or 93. On the other hand, in entering the optional magnification value, the magnification set key 94 is made first on for entering the optional magnification value. As the magnification value, three digit numbers below the decimal point can be entered. If the entered magnification is out of the available magnification limit, the CPU calculates the number of times of copying and each magnification value for each copy and displays them and the number of times of copying and magnification value are stored in the CPU 200.

Referring to FIG. 5, a flag F2 is determined in the step S21 and if the flag F2 is set, i.e., the magnification setting is presently being performed, the process goes to the step S27. If the flag F2 is reset, i.e., the magnification setting is not being performed, the process goes to the step S22, wherein it is determined whether or not the magnification set key 94 is on. With an on state of the magnification key 94, the process goes to the step S23. With an off state of the magnification key 94, it is determined in the steps S231 whether or not any one of the fixed magnification set keys 90 to 93 is made on. If any one of the magnification set keys 90 to 93 is made on, the selected magnification value is transferred to the memory location 206 to store the magnification value for preparing the magnification copy under the fixed magnification value.

If the magnification set key 94 is on, the process goes to the steps S23 to S26. In the step S23, the memory location 206 is cleared off and in the step S24, the flag F2 is set for indicating the process is in setting the magnification, and in the step S25, the digit number of the magnification data which shows the place of the digits of the memory location to be 1. In the step S26, the number of the copy to be repeated is cleared off.

When the process is advanced to the step S27 from the step S21, if it is detected in the step S27 that one of the ten keys 80 to 89 is made on, the process goes to the step S28 and the entered numeral data is stored in the corresponding place of the memory location 206 which corresponds to the content of a counter which indicates the place of the digits of the entered magnification value (said counter is referred to as the place counter) In the step S29, the subsequent digit of the data is allowed to be enters and the place counter is increased by 1 for designating the place of the memory location to which the subsequently entered value is stored.

Since the preferred embodiment of the copying machine is so designed that four effective digits of numerals with three digit numbers below the decimal point can be useful, in the step S210, the content of the place counter is determined and if the content of the place counter is 5, entrance of the numerals beyond four digits of magnification value is rejected. Then the process goes to the step S211 to reset the flag F2. If the content of the place counter is less than 5, the process returns to the main routine and consequently to the step S21. When the magnification setting is being performed and therefore, the flag F2 is in the set condition, if the magnification set key 94 is pressed, the process goes to the step S211, wherein the flag F2 is reset to inhibit entering the data from the ten keys 80 to 89 as the magnification value data, then the process goes to the step S213 shown in FIG. 6.

Figure 12:
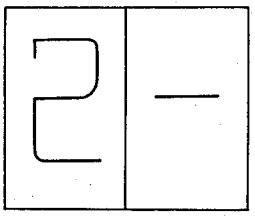
Figure 12:
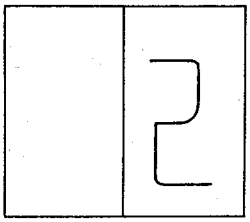

It is determined in the step S213 whether or not the entered magnification value is larger than the maximum limit magnification which can be obtained by only one cycle of copying. If the entered magnification is larger than said magnification, the process goes to the step S214, wherein the entered magnification stored in the memory location is copied to the memory location for storing the magnification out of range of the available magnification limit (the memory location is referred to as the out of range memory location hereinafter) and the copy times is set to 1. When the copy number is not 0, the display unit 73 displays the copy number and the display unit 72 displays the magnification value used for a copy at a time. The required copy number for making the desired magnification copy can be displayed in such a manner that the desired copy number is displayed on the leftmost place (the most significant digit) of the display unit 73 as shown in FIG. 12*a* with a hyphnation displayed in the adjacent right place so as to facilitate to distinct the normal copy number as shown in FIG. 12*b*.

The display unit 95 serves to display the magnification value data as of out of the available magnification limit.

Subsequently, in the step S215, the desired magnification stored in the memory location 206 is divided by the maximum limit magnification of the copying machine and the result of the division is stored again in the memory location 206. In the step S216, the copy times is increased by "1", and the process goes to the steps S217 and 218 and it is determined whether or not the magnification data is within the available magnification limit and if the magnification is out of the available magnification limit, the process goes back to the step S215 so as to repeat the operations mentioned above until the magnification data stored in the memory location 206 becomes less than the maximum magnification limit, increasing the copy number by 1.

It should be noted that the magnification data to be divided is the entered magnification on first dealing of the step S215 and a quotient of the division on and after second dealing thereof.

When said repetition is completed, the magnification value data stored in the memory location 206 is the magnification value data which is smaller than the available magnification. The other magnification data is not stored in the memory locations this data is coincided with the available magnification limit, such data is not necessary to be stored.

If the copy times becomes more than 10, the process goes to the step S219 to limit the copy times to 9 and the step S220 to set a flag F4 to show that the copy number exceeds the available magnification limit. When the flag F4 is set, the display on the unit 73 is flickered to show that the copy number exceeds a predetermined value. As the quality of the copy is deteriorated as the number of times of copying another copy is increased, the number of times of copying is limited. The limit of the number of times of copying need not be limited to 10. It is not essential to limit the number of times of the copy.

Through the above operation, the number of times of copying and the magnification value of the first time copy for the desired magnification copy are decided. On the other hand, the respective magnification values after the second time copies are decided in a manner as mentioned later with reference to FIG. 8. To put it briefly, if the magnification value stored in the memory location 206 is larger than 1, the maximum limit magnification of the copying machine is transferred to the memory location 206. To the contrary if the magnification value stored in the memory location 206 is smaller than 1, the minimum limit magnification of the copying machine is transferred to the memory location 206.

By this operation, at the enlarging or decreasing, the copy with the desired copy magnification value can be made by the minimum number of times for copy.

For example, assuming that the desired copy magnification value is 2.3, and the available magnification limit is 0.640 to 1.420, the magnification copy can be made by such operations that $2.3 = 1.414$ (the first time magnification copy) $\times 1.420$ (the second time magnification copy) $\times 1.420$ (the third time magnification copy), whereby the desired magnification copy can be made with a minimum number of times of copying.

Figure 6A:
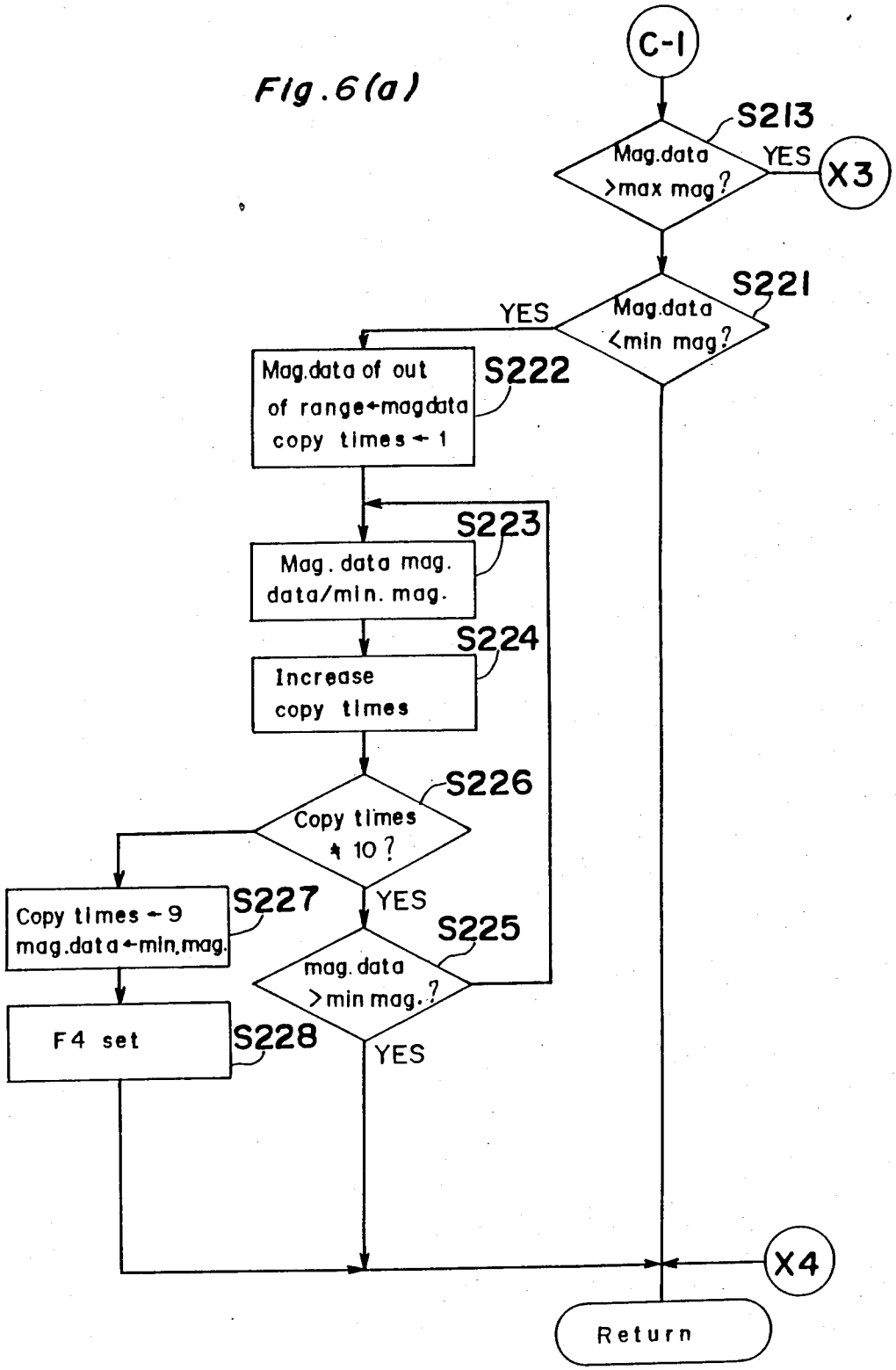
Figure 6B:
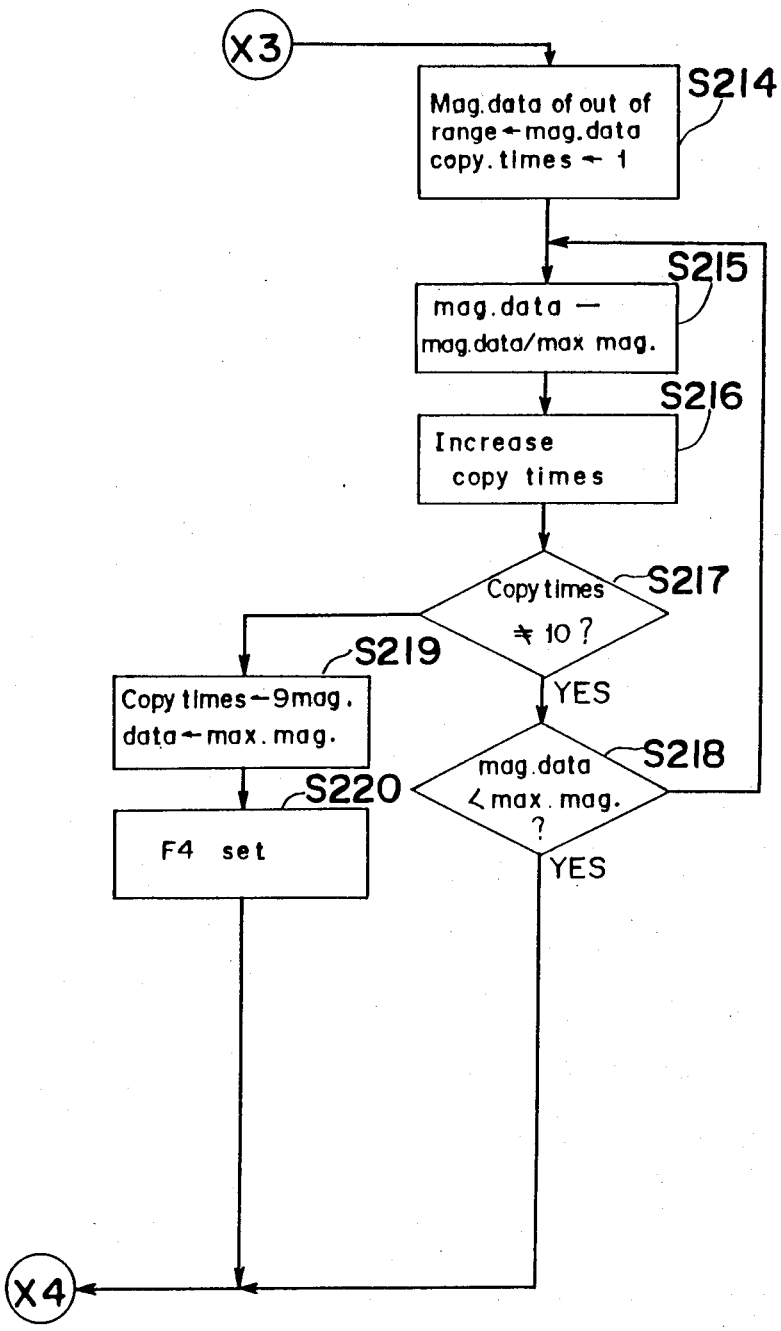
Figure 7A:
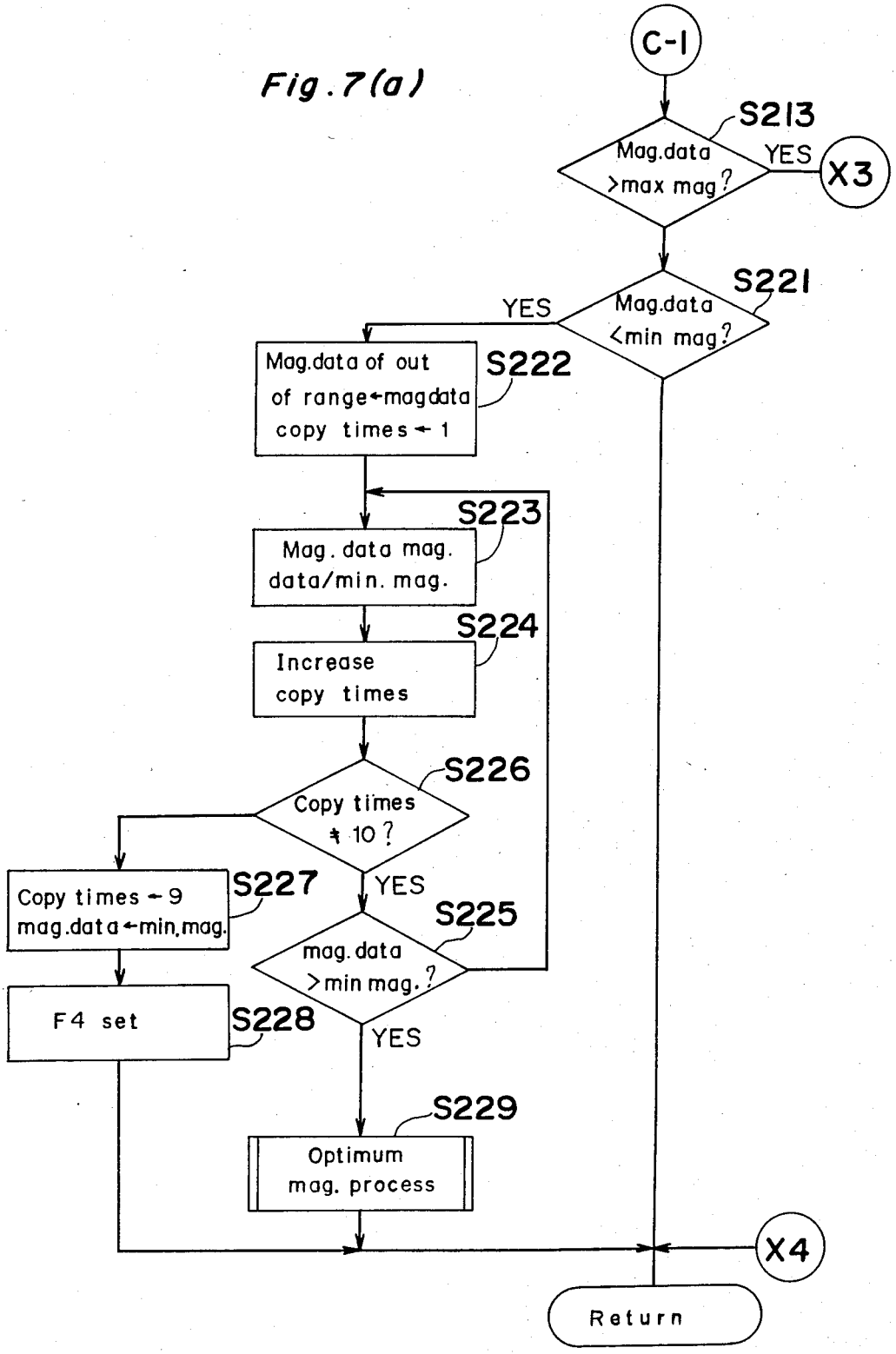
Figure 7B:
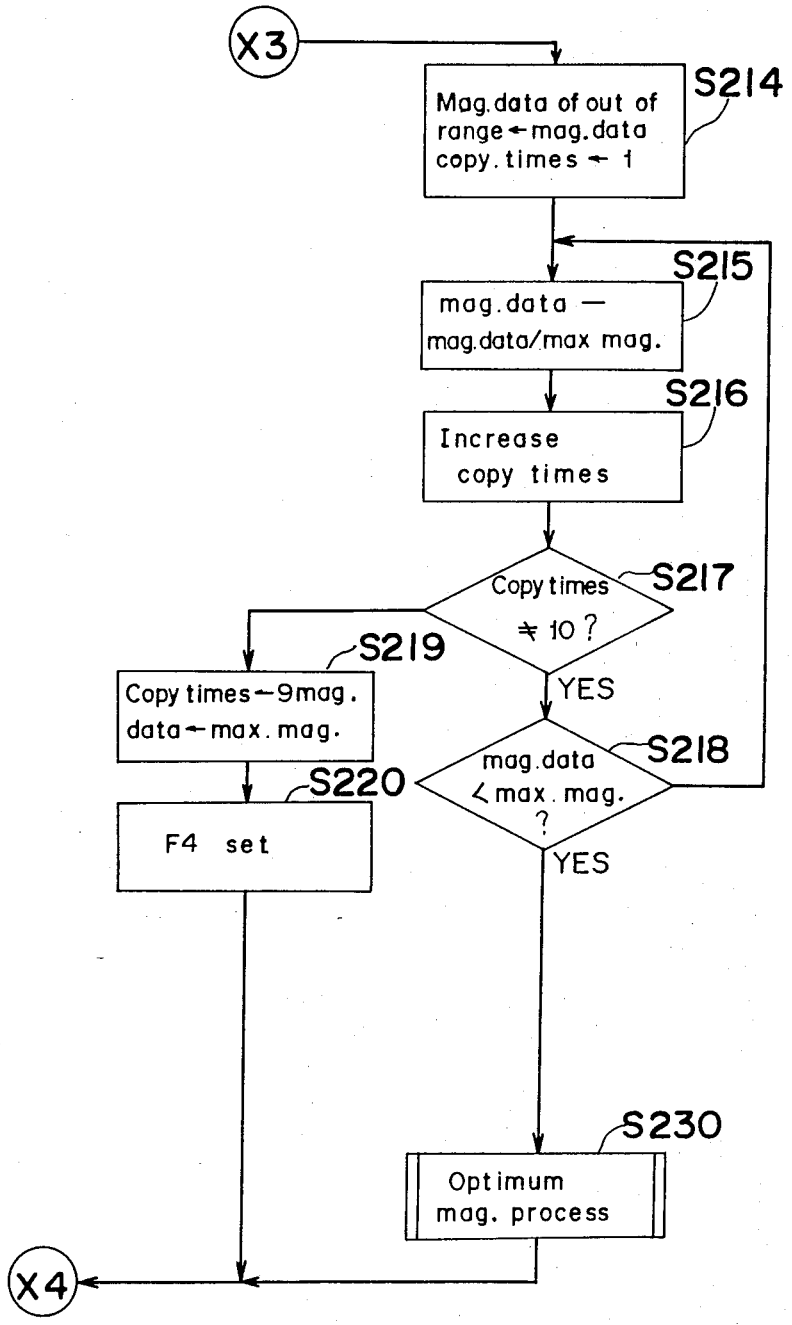
Figure 11:
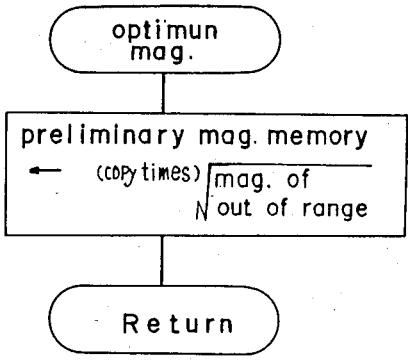

In the embodiment shown in FIG. 6, the copy magnification is changed once through the consecutive copy operations. To the contrary, it may be possible to perform a magnification copy with the same magnification value at every copy operation using an optimum magnification setting process as shown in FIG. 7. The optimum magnification setting process may be made in the program shown in FIG. 11.

In the step S51, following calculation is conducted $$\text{magnification} = \sqrt[c]{\text{entered magnification}}$$

wherein c is number of times for copy

In this case, the calculation of the uniform magnification value enables the omission of the magnification changing during the consecutive copy operations.

Figure 8A:
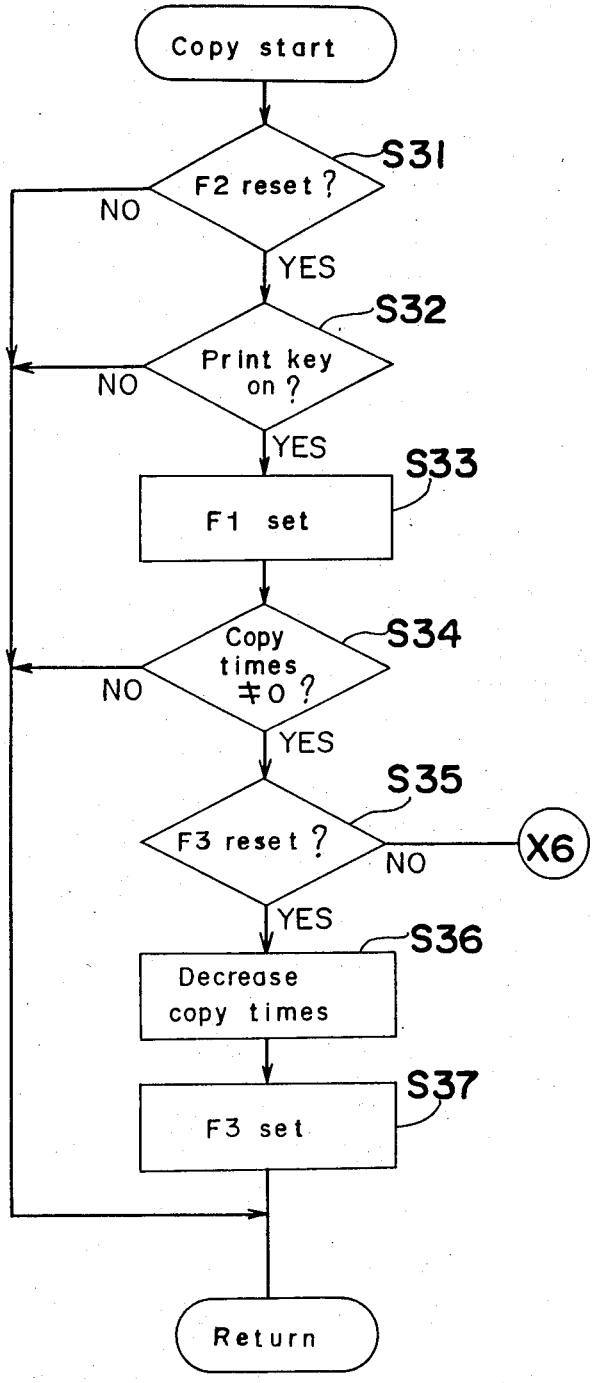
Figure 8B:
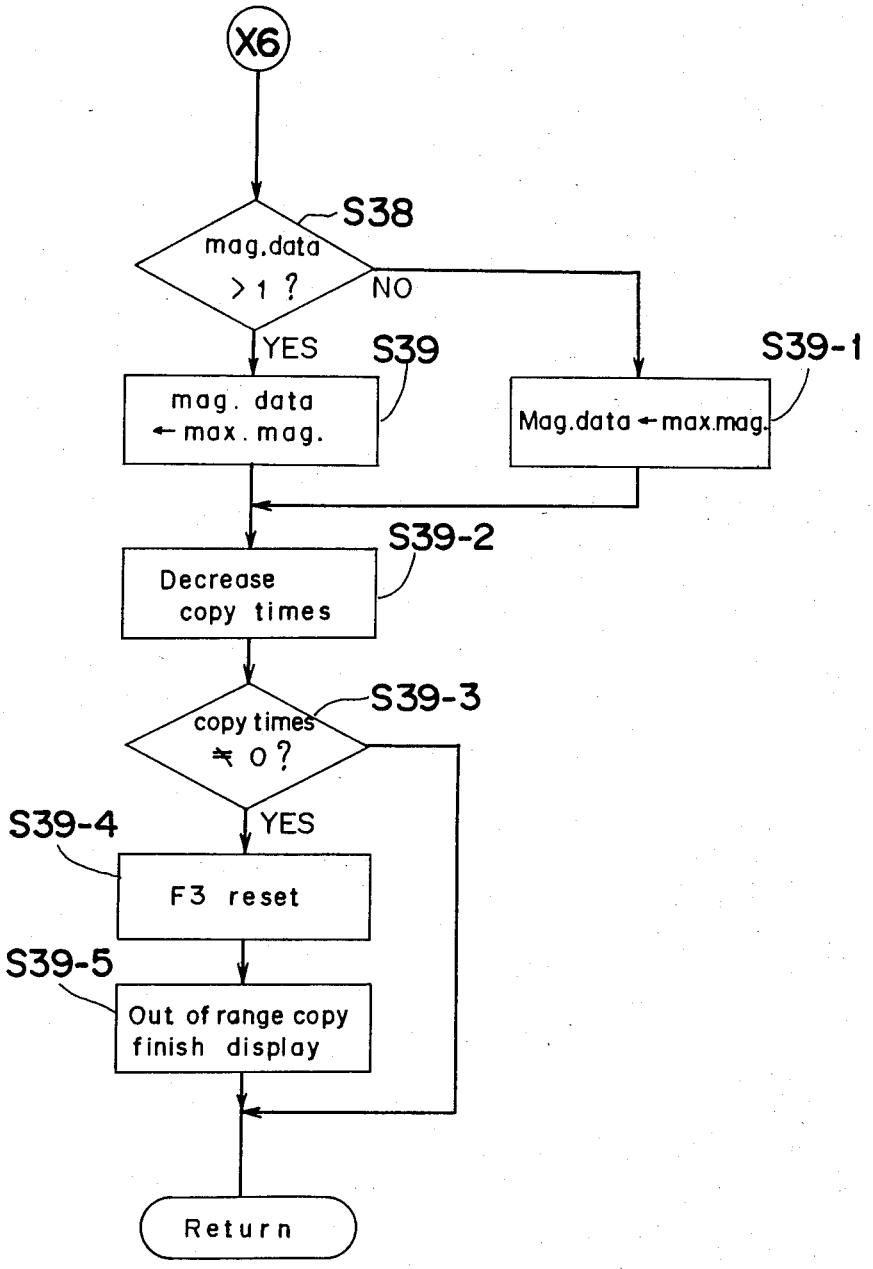

Referring to FIG. 8 a print start routine indicated as the step S15 in FIG. 4 which is initiated by depressing the print key 71.

If the entered magnification value is out of the available magnification limit, a copy is executed based on the magnification data stored in the memory location 206. The number of times for copying is decreased and is displayed in the display unit 73. Thus, the operator can notice how many times a copy must be still made for obtaining a copy with the desired copy magnification by watching the content of the display unit 73. Then by repeating the copies while replacing the original by the material which is a magnified copy, the content of the display unit 73 is changed as 3−, 2−, 1−. When the content of the display unit 73 becomes the normal number of copy, the operator can notice that the copy operation of the desired magnification is completed. Thus the copy with the desired copy magnification can be obtained only by performing the copying according to the indications displayed in the display unit 73. A detailed operation of the above operation will be described with reference to FIG. 8.

It is determined in the step S31 whether the magnification setting is being proceeded or not by watching the set condition of the flag F2. With the reset of the flag F2, the process goes to the step S32. With the set of the flag F2, i.e., during the magnification setting is proceeded, the processes after S32 are not performed.

In the step S32, it is determined whether the print key 71 is depressed, and with an on of the print key 71, the processes after S33 are executed.

In the step S33, the flag F1 is set to indicate that "the copy is busy" and the process goes to the step S34, wherein it is determined whether the copying operation under the present operation is made within the available magnification limit. Specifically, with 0 of the number of times for copy, CPU determines that the copy under the present operation is the normal copy i.e., the copy is within the available magnification limit and the process after the steps S35 is not executed. When it is determined that the copy is made with the magnification out of the available magnification limit, the process goes to the step S35. In the step S35 if the flag F3 is in the reset condition, it is detected that the present procedure is the copy start directly after the completion of the magnification setting and the process of the first time copy with a magnification value out of the available magnification limit is prepared. In the step S36 the number of times for copying is deceased. In the step S37, the flag F3 is set so as to indicate that the subsequent copies are copies on and after under the magnification out of the available magnification limit.

As the magnification value data is still stored in the memory location 206 at the time directly after the copy magnification setting, the stored data is used as the copy magnification data. Thus the process of writing the possible magnification data in the memory location may be omitted in the procedure.

The magnification value setting mechanism is set by said magnification data read out of the memory location 206, and the first time of the copy operation for the desired magnification is started. The copy operation on and after the second times is made by the processes after the step S38, wherein it is determined whether the magnification value data stored in the memory location 206 is larger than 1. With YES, the process goes to the step S39, and the maximum available magnification value data is stored in the memory location 206 as the magnification data. With NO in the step S38, the minimum magnification value data is set in the memory location in the step S309-1. The magnification mechanisms is adapted with the set maximum or minimum magnification value.

In the step S309-2 the number of times for copying is decreased and the process goes to the steps S309-3 to S309-5 to determine whether the copy of the out of the available magnification limit is completed or not. If the times for copy is 0, the flag F3 is reset in order to show that the magnification out of the available magnification limit is completed. If the times for copy is 0, the display unit 73 displays the number of copies, so that the operator can notice that the magnification copy of the available magnification limit is completed.

Figure 9A:
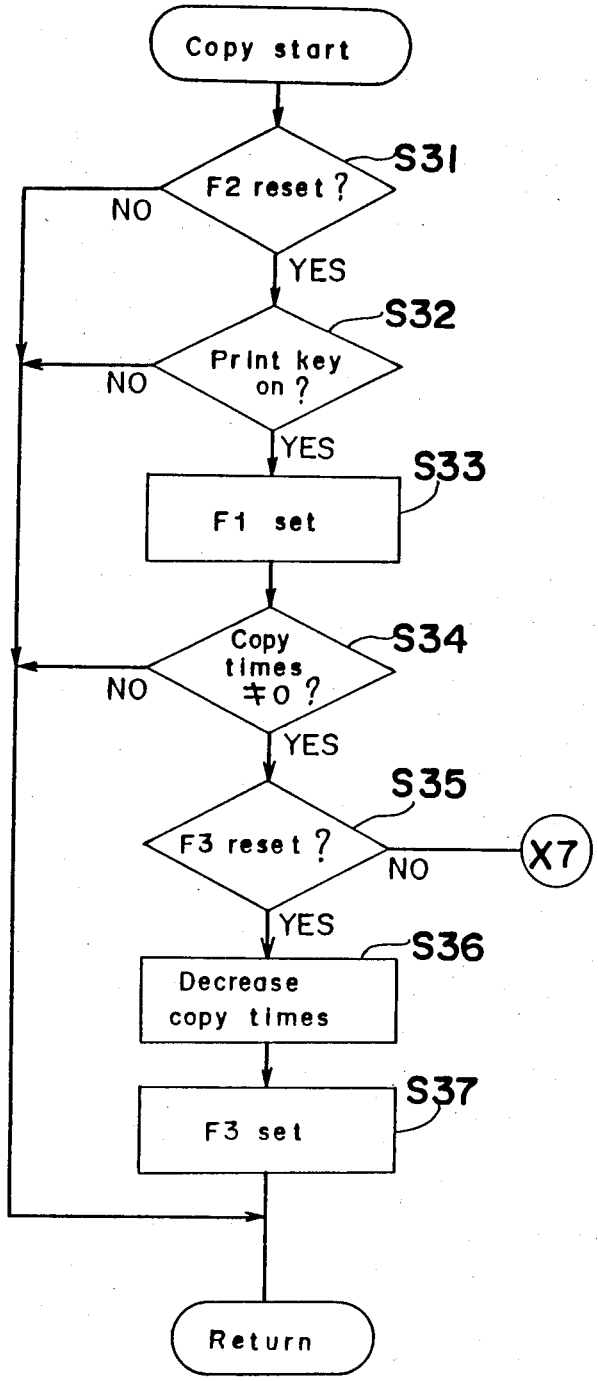
Figure 9B:
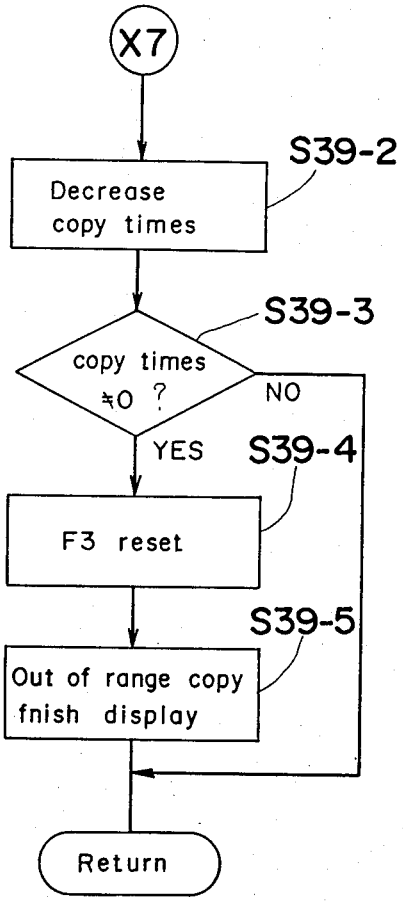

FIG. 9 shows one modification of the subroutine for copy start process corresponding to another embodiment shown in FIG. 7, wherein the steps S38, S39 and S309-1 are eliminated from the process shown in FIG. 8.

Figure 10:
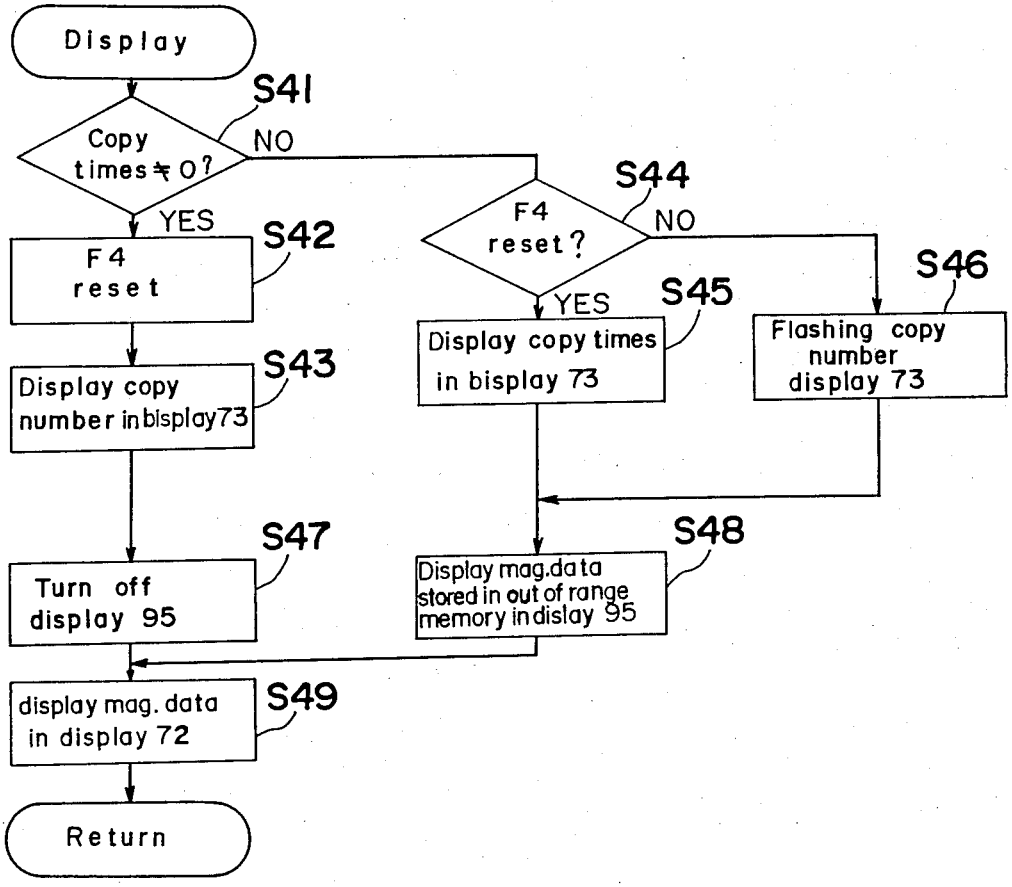

FIG. 10 is a flow chart showing the process for processing the display data for the display units 72 73 and 95.

In the step S41, it is determined whether the display of the number of times for copying or display of the number of copies is presently processed. If the number of times for copying is not 0, the process goes to the step S44 to display the number of times for copying.

In the step S42, the flag F4 for indicating that the number of times for copy exceeds the predetermined value is reset. In the step S43, the number of copying is converted to the display coded data which is transferred to the display unit 73. In the step S47, the display unit 95 is turned off, whereby it is noticed that the normal copy (copy within the available magnification limit) is being executed. In the steps S44 through S46, the state of the flag F4 is determined so as to decide to display continuously or flickeringly.

If the flag F4 is in the set state which indicates that the number of times for copying exceeds the predetermined value, the display unit 73 is flickered.

In the step S48, the data stored in the memory location 206 is converted to a display coded data for the display unit 95 and is transferred and displayed. Finally in the step S49, the magnification data used in the present copy operation is converted to a display coded data for the display unit 72.

Another embodiment of the copying machine according to the present invention is explained with reference to FIG. 13 through FIG. 20 in which like parts in the embodiment described above are designated by like numbers and the detailed explanation thereof is omitted.

Figure 13A:
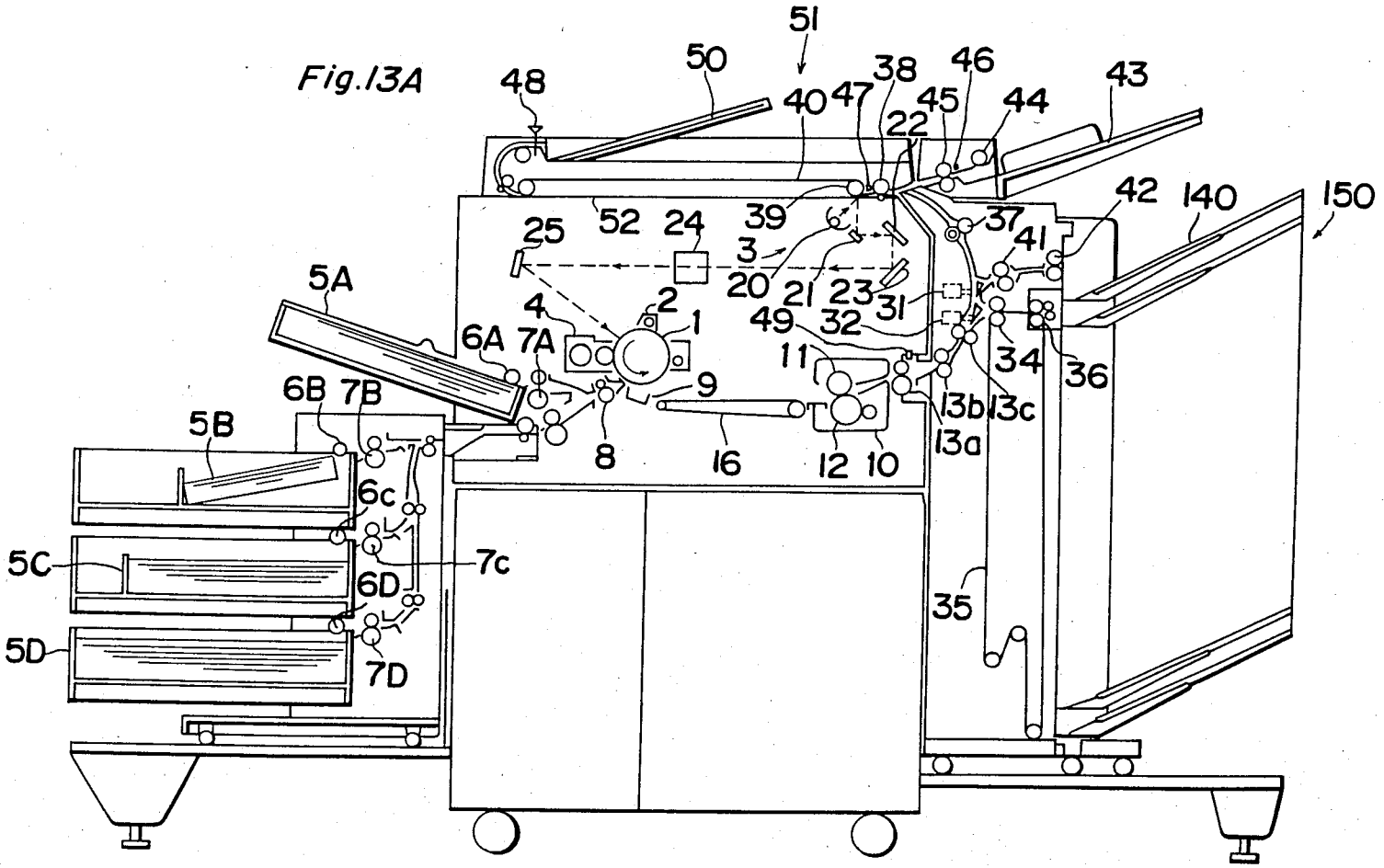
FIGS. 13A and 13B are schematic diagrams showing another embodiment of a copying machine according to the present invention.
Figure 13B:
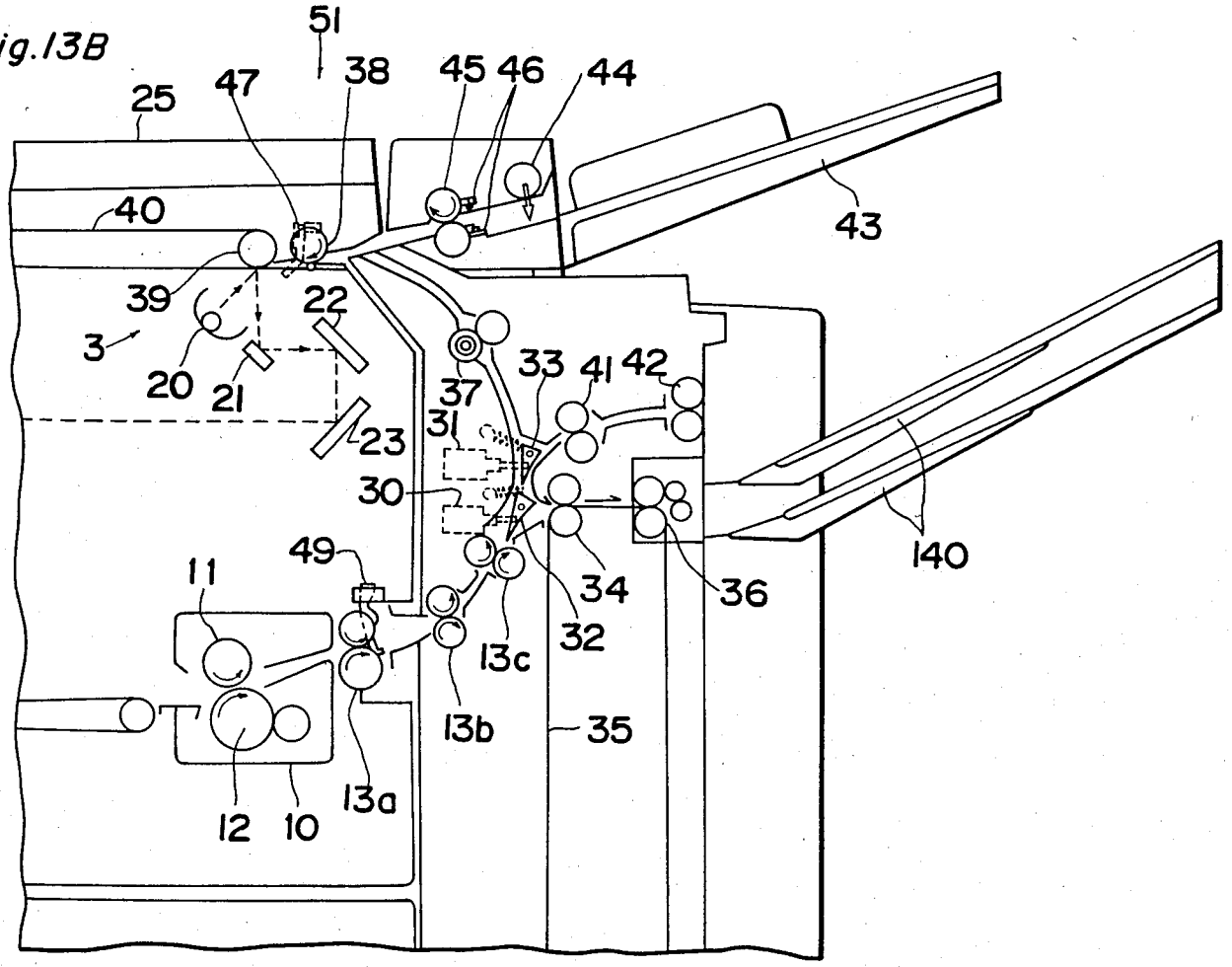

Referring to FIG. 13 comprised of FIGS. 13A and 13B, various sizes of the copy papers are respectively accommodated in cassettes 5A to 5D. The copy papers can be taken out from the cassettes 5A to 5D by rotation of feeding rollers 6A to 6D and the copy papers thus taken out are respectively transferred to the copying machine through transport rollers 7A to 7D. A sorter 150 is provided at the right side portion of the copying machine so as to receive the copy paper fed from the fixing device 12. The copy paper may be transported to an original feeding device 51 when the copy with the magnification out of the available magnification limit is performed. FIG. 13B shows the paper feeding mechanism in which a path change over mechanism including change over tips 32 and 33 each driven by solenoids 30 and 31 is provided. Furthermore, in order to feed the copy paper to bins in the sorter trays 140, take in sorter rollers 34, a sorter belt 35 and movable rollers 36 are provided. The change over tip 32 is disposed behind intermediate pinch rollers 13*c* and the change over tip 33 is provided behind the change over tip 32 so as to select one of the branched paths by the operation of the solenoids 32 and 33. When the solenoid 30 is turned on, the path to the sorter tray 140 can be selected so that the copy paper can be discharged to one of the bins situated below a top bin through the take in sorter rollers 34, the sorter belt 35 and the movable transfer rollers 36. When the solenoid 30 is turned off, the path coming from the intermediate pinch rollers 13*c* can be communicated with the path having the change over tip 33. When the solenoid 31 of the change over tip 33 is turned off, the transfer path is communicated to the path having take in pinch rollers 37 so that the copy paper is transported to the platform 52 through the take in pinch rollers 37, DF feeding pinch rollers 38 and a DF belt 40 driven by the DF belt roller 39 then copying operation is repeated until the copy with the desired magnification can be obtained. When a calculated number of times for copying is repeated, the solenoid 33 is turned on, whereby the copy paper with the desired magnification is transported to the top bin of the sorter tray 140, then the copy operation for the out of the available magnification limit is finished.

In order to place the source original on the platform 52, the original is put on the original feeder 43 attached to the right portion of the copying machine, then the print key 71 is depressed, the source original is transported by DF pinch roller 44, a pair of DF feeding rollers 45 to the platform 52 through passing the above mentioned DF feeding pinch rollers 38, DF belt roller 39 and the DF belt 40.

A sensor 46 for detecting the original (referred to as the original sensor) is provided in the intermediate portion of the path of the original. Reference numerals 47, 48 and 49 are sensors for detecting the passage of the original from the original feeder 43, the DF discharging detector, and a copier discharging detector. The original already used is transported to an original discharging tray 50.

Figure 14:
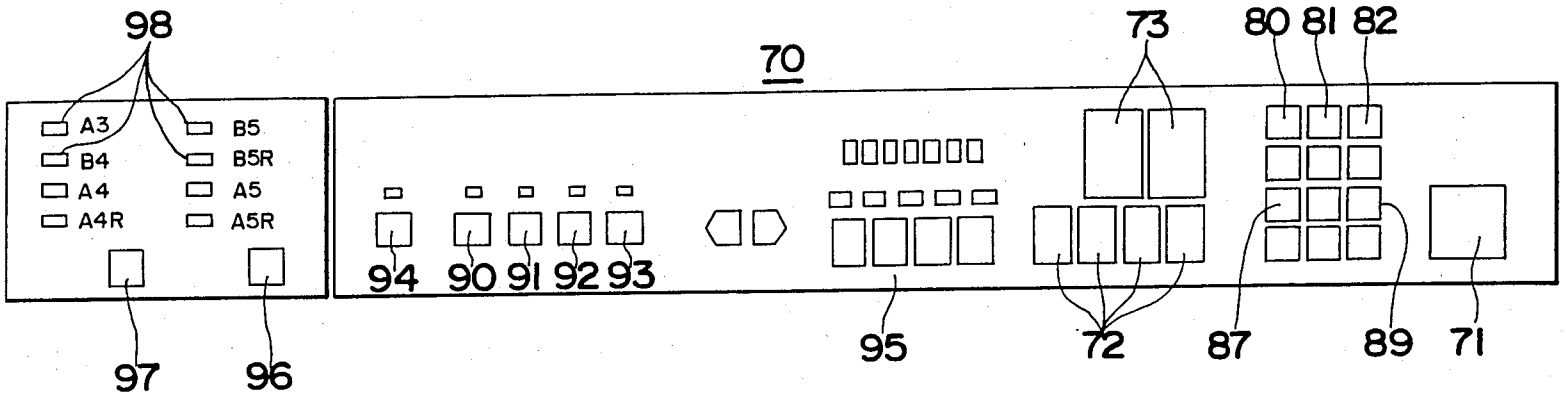
FIG. 14 is a top plan view of an operation panel used in the copying machine shown in FIGS. 13A and 13B.

Referring to FIG. 14, a mode setting key 96, original size select key 97 and a plurality of paper size display units 98 are provided in the left half of the control panel 70. The mode setting key 96 is provided for setting a mode in which a copy paper of optimum size is automatically selected corresponding to the size of the source original or the material to be dealed as the original and the designated magnification value. The original size select key 97 is provided for selecting the size of the source original. The selected size of the original can be changed each time the original size select key 97 is depressed and any one of the display units 98 is turned on in response to the selected original size due to the operation of the original size select key 97.

TABLE

| | copy magnification | | | | | | |
|---|---|---|---|---|---|---|---|
| S.O. | × 0.640~ × 0.711 | × 0.712~ × 0.823 | × 0.924~ × 0.871 | × 0.872~ × 0.871 | × 1.008~ × 1.159 | × 1.160~ × 1.231 | × 1.232~ × 1.420 |
| A5 Y | A6 Y | B6 Y | B6 Y | A5 Y | B5 Y | B5 Y | A4 Y |
| A5 X | A5 X | A5 X | A5 X | A5 X | B5 X | B5 X | A5 X |
| B5 Y | B6 Y | A5 Y | B5 Y | B5 Y | A4 Y | B4 Y | B4 Y |
| B5 X | A5 X | A5 X | B5 X | B5 X | A4 X | A3 Y | A3 Y |
| A4 Y | A5 Y | B5 Y | B5 Y | A4 Y | B4 Y | B4 Y | A3 Y |
| A4 X | A5 X | B5 X | B5 X | A4 X | A4 X | A3 Y | A3 Y |
| B4 Y | B5 Y | A4 Y | B4 Y | B4 Y | A3 Y | A3 Y | A3 Y |
| A3 Y | A4 Y | B4 Y | B4 Y | A3 Y | A3 Y | A3 Y | A3 Y |

note;
X lateral attitude,
Y longitudinal attitude
S.O.; size of the source original The above table shows the correspondence among the size of the source original selected by the key 99 and the optimum copy paper size and its attitude under the automatic paper feeding selection mode. The table is stored in the RAM of the CPU 200.

The copying machine automatically selects any one of the paper size and its attitude according to the above table under the automatic paper feeding selection mode and selects any one of the cassettes 5A to 5D in which the optimum paper is contained and feeds the paper by driving any of the paper feeding rollers 6A to 6D in the copying machine.

The optimum paper size means such paper size that the whole picture of the original is copied on the copy paper irrespective of the normal copy and magnified copy with the magnification out of the available magnification limit.

When the magnification is large, there occurs such a case that the whole picture of the source original can not be copied on the paper, for example, in case of enlarging the source original of A3 size with magnification of 1.420. In this case, according to the embodiment, a maximum paper size to be available is selected. Namely, if the optimum size paper is not mounted in the copying machine, the paper nearest to the optimum size paper can be automatically selected.

For example, when the source original is A4 size with the longitudinal attitude and magnification of ×0.816, the optimum paper size and attitude of the copy paper are B5 with longitudinal attiude. In case the paper of B5 is absent, a paper of size A4 with longitudinal attitude is selected.

For example, when the source original is B5 with longitudinal attitude with the magnification of ×1.414, the optimum paper is B4. If the paper of B4 is absent, the paper of A3 is selected.

In case the copy is made with the magnification out of the available magnification limit, the second time a copy is made by using the paper copied at the first time copy. In this condition, the copied paper is used as the original in the second time copy. The copy in the second time is performed with the size of the original set by the size of the copied paper made in the first time copy. And the optimum size of the paper is selected corresponding to the size of the original which is made by the prior magnified copy.

Figure 15:
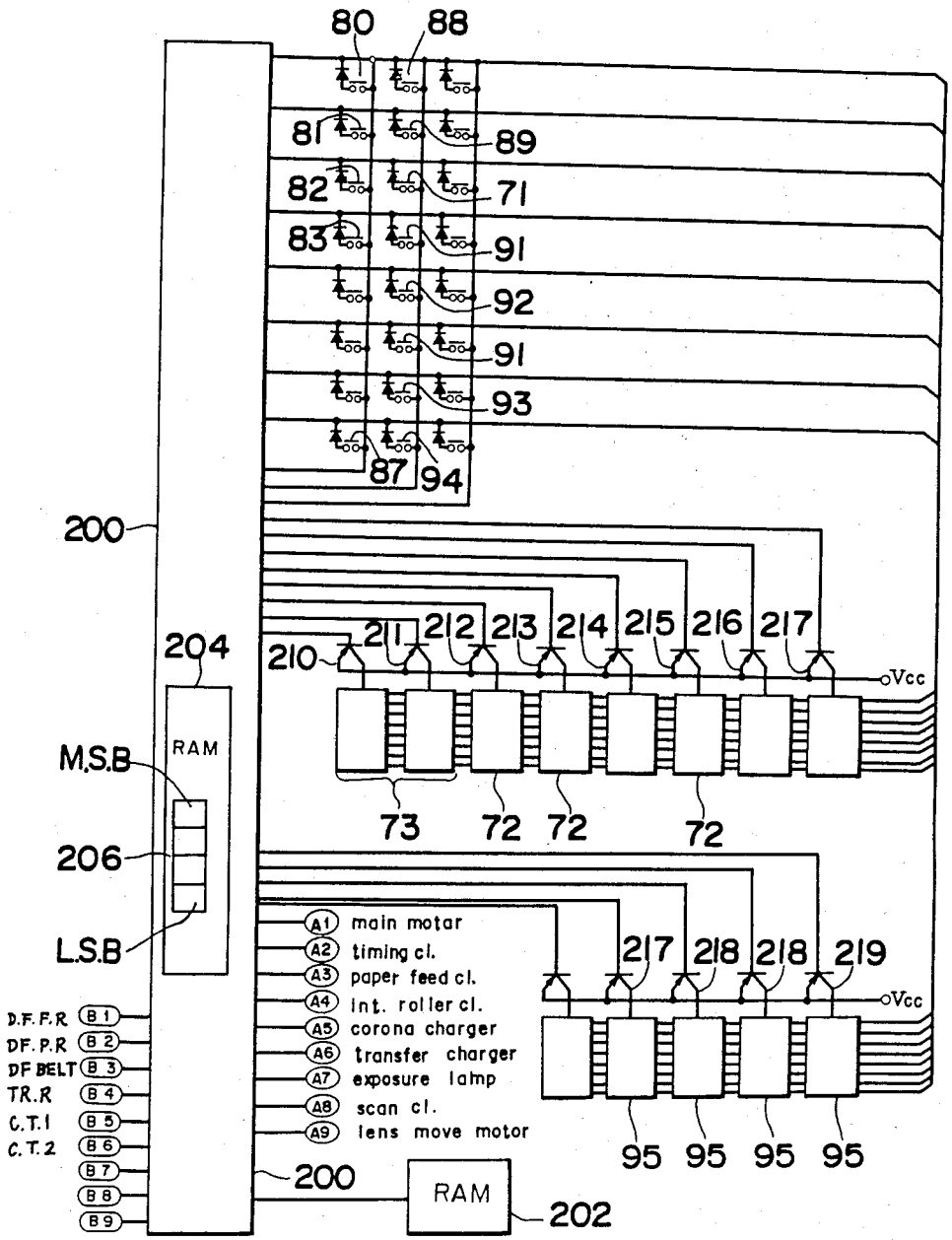
FIG. 15 is a schematic diagram showing a block diagram of a control device used in the copying machine shown in FIGS. 13A and 13B, FIGS. 16 through 19 are respectively flow charts showing essential portions of the copying machine shown in FIGS. 13A and 13B.

In FIG. 15, DF.F.R means a motor for the DF feed roller, DF P.R. means a motor for the DF pinch roller, TR.R. means a motor for the transport roller and C.T. means the solenoid for the change over tip.

Figure 16:
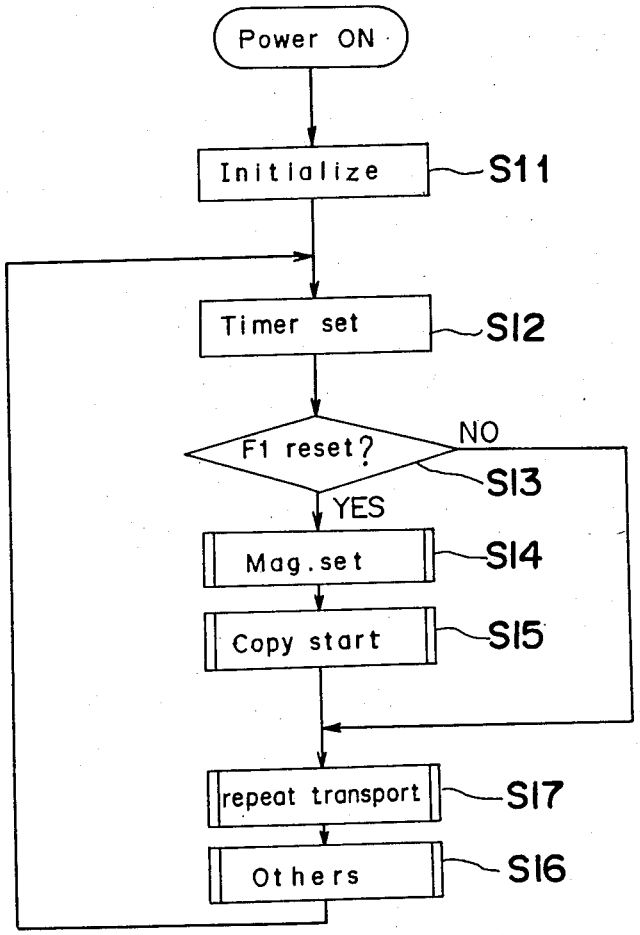

Referring to FIG. 16 which is a modification of the program shown in FIG. 4 in which the step S17 is added. In the step S17, the copied paper is transported to the platform 52 after the copied paper is subjected to the fixing process in the copy mode for the magnification out of the available magnification limit.

Figure 17:
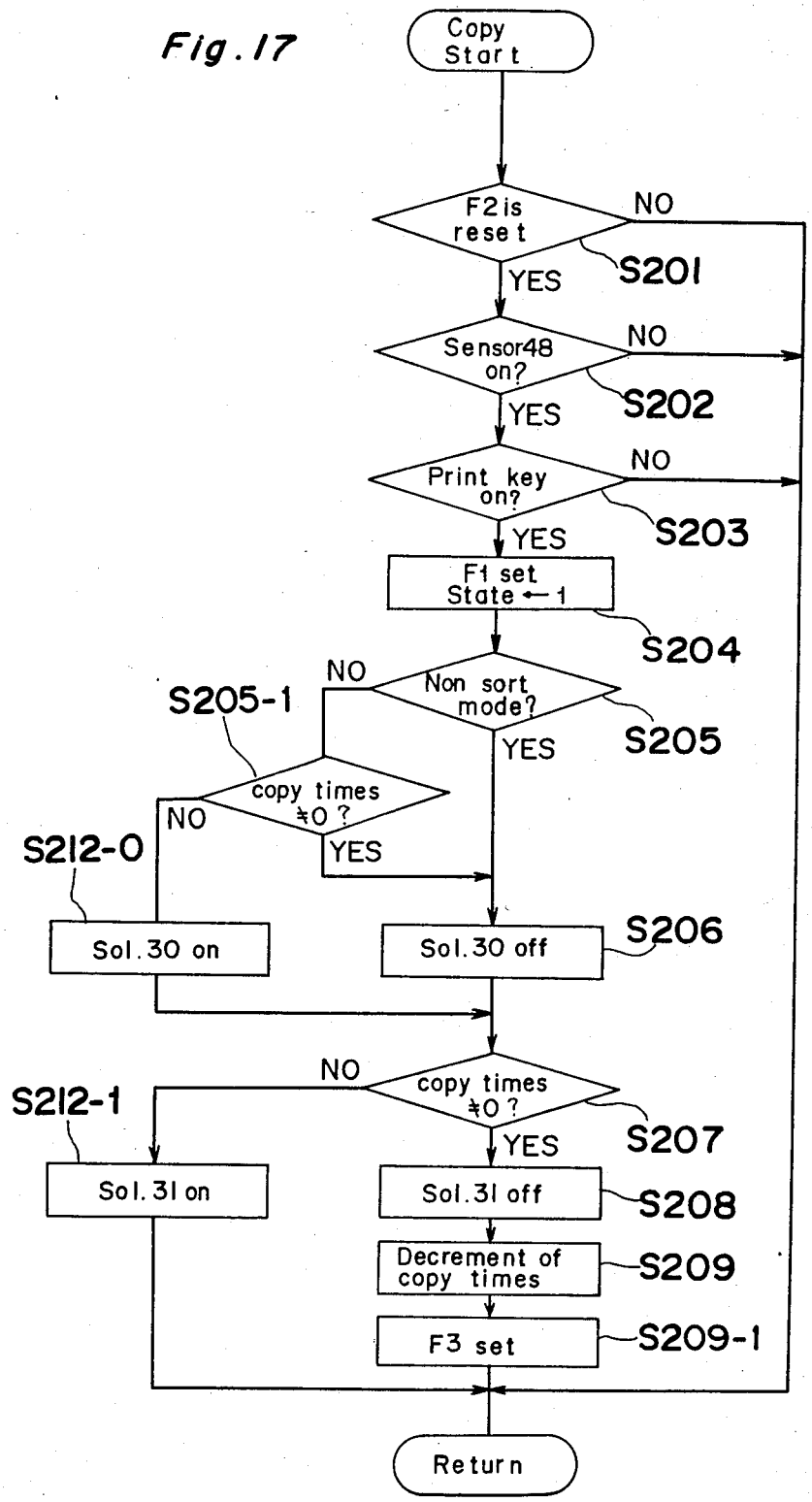

Referring to FIG. 17 showing the copy start routine in the second embodiment, in the step S201, the state of the flag F2 is determined. If the flag F2 is reset, the process goes to the step S202. If the flag F2 is set, the processes after S202 are not performed.

In the step S202, it is determined whether the original is put on the original feeder 43 by the output of the original sensor 46. In case the original is absent in the paper feeder, the process returns without performing any procedure. In case the original is present in the original feeder 43, the process goes to the step S203 wherein it is determined whether or not the print key is depressed. In case of YES, the process goes to the step S204 wherein the flag F1 is set to indicate that copy is busy and a state number designating the state of the repeating the copy is made 1 and then the process goes to the step S205.

In the step S205, if the sort mode is not designated, the process goes to the step S206 to turn the solenoid 30 off so that the copied paper is delivered to the change over tip 33.

In case of sort mode, the process goes to the step S205-1 wherein if the number of times for copy is not 0, the the process goes to the step S206. While with the number of copy is 0, namely, in case of the normal, the copy or the final copy in the mode of out of the available magnification limit, in the step S212-0, the solenoid 30 is turned on so that the copied paper is transported to one of the bins lower than the top bin in the sorter tray 140 through the change over tip 32.

In the step S207, it is determined whether the present copy operation is out of the available magnification limit. If the present copy is a normal copy the process goes to the step S212-1 to turn the solenoid 31 on for switching the change over tip 33 so that the copied paper is transported to the top bin of the sorter array 140.

When it is detected that the present copy is out of the available magnification limit, the process goes to the step S208, wherein the solenoid 31 for the change over tip 33 is turned off so that the copied paper is transported to the platform 52, then the number of times for copy is decreased in the step S209.

In the step S209-1 the flag F3 is set to indicate that the subsequent copies are the copy out of the available magnification limit.

FIGS. 18*a* to 18*i* show the subroutines for transporting the copied papers to the platform repeatedly.

Figure 18A:
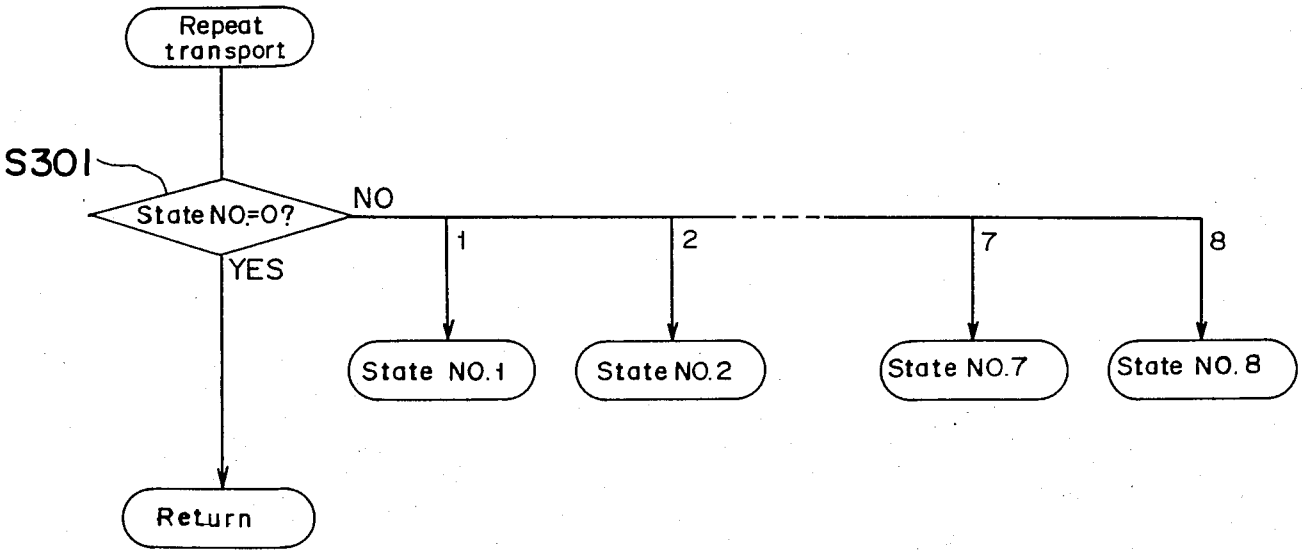

FIG. 18*a* shows the general operation of the repeating copy for the copy with the magnification out of the available magnification limit. There are nine states from 0 to 8. The state number 0 represents a "ready" to copy. When the copy is started, the state number is set to "1". The state number progresses one by one each time one subroutine is completed.

Figure 18B:
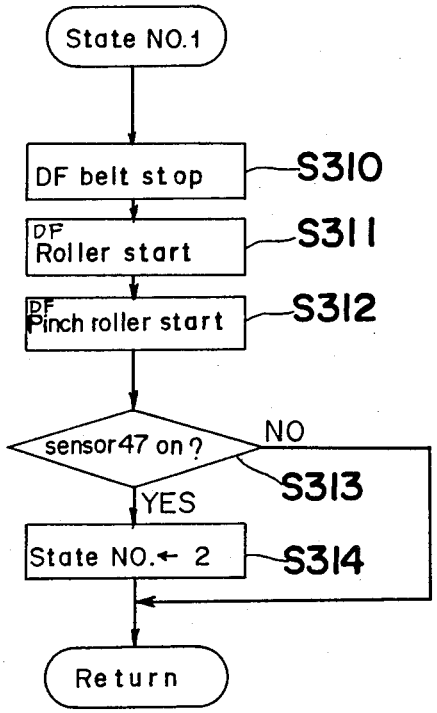
Figure 18C:
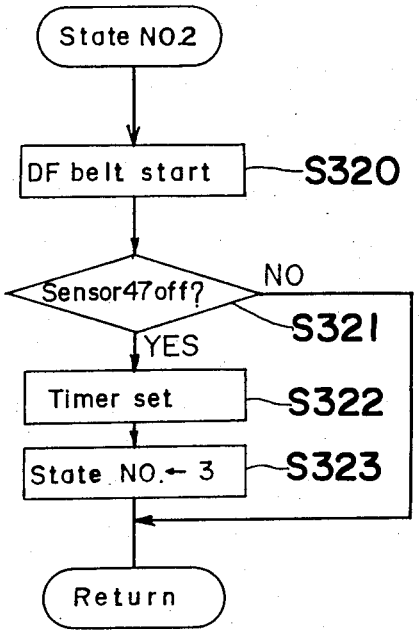

When the signal of the print key 71 is entered, the state number is set by "1" in the step S204 (FIG. 17), and the procedure shown in FIG. 18*b* is performed. In the step S310, the DF belt 40 is stopped. In the step S311, the DF feeding rollers 45 are started. In the step S312, the DF pinch rollers 44 are started. Since the DF belt 40 is stopped at the first time copy of out of the available magnification limit, the step S310 has nothing to do with the operation. However once the DF belt 40 is started after the second time copy, the belt 40 is stopped in the timing of the operation of the step S310. In the step S313, the state of the paper sensor 47 is determined and the state number 1 is kept as it is until the paper sensor 47 is made on. When the paper sensor 47 is turned on by detecting the passage of the copy paper, the state number is set to 2 in the step S314.

In the step S320, the DF belt 40 is started and in the step S321, the rear edge of the original is detected by the turning off of the paper sensor 47 then the process goes to the step S322 to start a timer and in the step S323, the state number is made 3. The length of time set in the timer is such a time to be long enough so that the paper reaches the possible position after the rear edge passes the paper sensor 47.

Figure 18D:
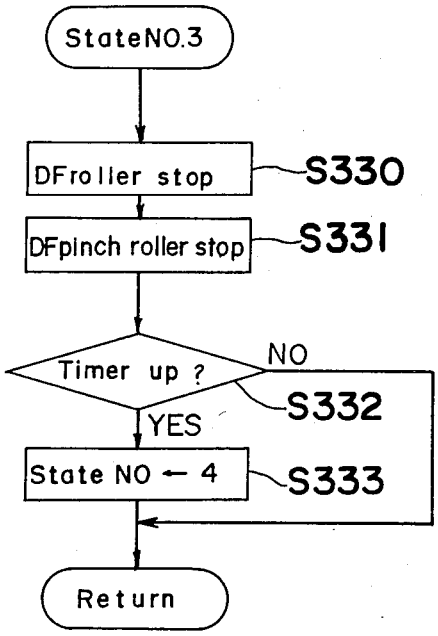

In FIG. 18*d*, the DF rollers 45 and pinch roller 44 are stopped, whereby the DF rollers 45 and pinch roller 44 are made free rotation, whereby the original can be transported to the platform 52 by the rotation of the DF belt 40. If the timer operated in the step S322 is completed, the state number is made 4 in the step S333.

Figure 18E:
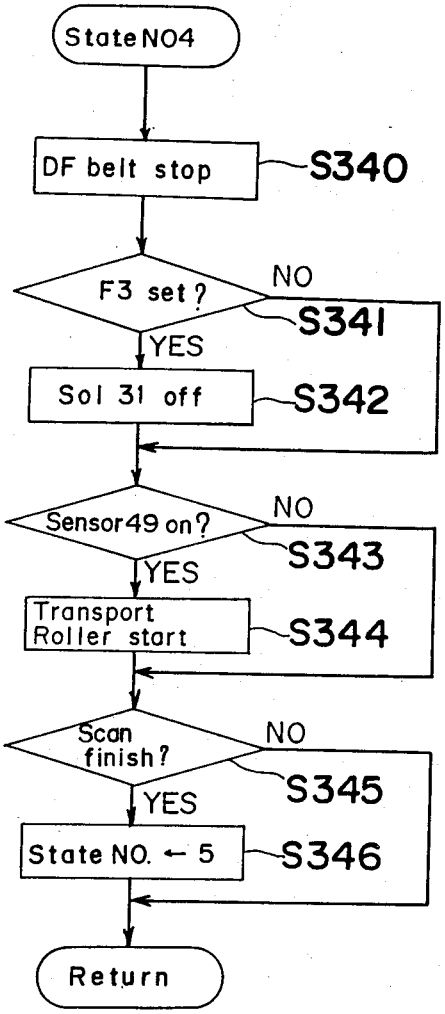

In FIG. 18*e*. the DF belt 40 is stopped in the step S340 since the original is transported to the predetermined position and the setting of the original is made complete.

In the step S341, it is decided whether the copied paper is discharged to the top bin of the sorter tray or the copied paper is transported to the platform 52.

If the flag F3 is set, the change over tip 31 is changed so that the copy paper is transported to the platform 52.

In the step S343, when the copied paper is transported to the discharging sensor 49, the process goes to the step S344 to start the rollers 13*a* and 13*b*, 13*c* then the transfer rollers 13*a*, 13*b*, 13*c* are started so that the copied paper is transported to the platform 52 or to the top bin of the sorter tray 140.

When the scan is completed in the step S345, the state number is made 5 in the step S346.

Figure 18F:
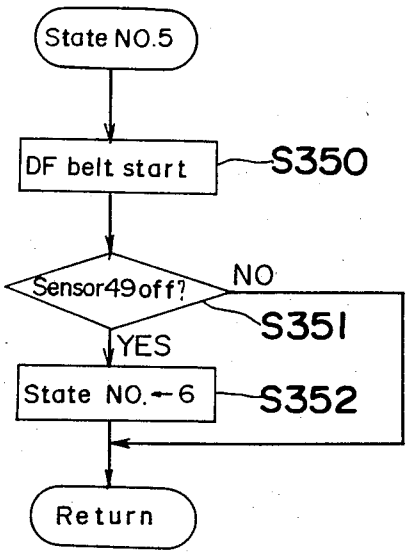

In FIG. 18*f*, when the exposure process is completed after scanning, the DF belt 40 is started in the step S350 so as to discharge the original already scanned and exposed.

When the rear edge of the copied paper passes the copier discharging sensor 49, the process is advanced to the step S352 from S351 to set the state number "6".

Figure 18G:
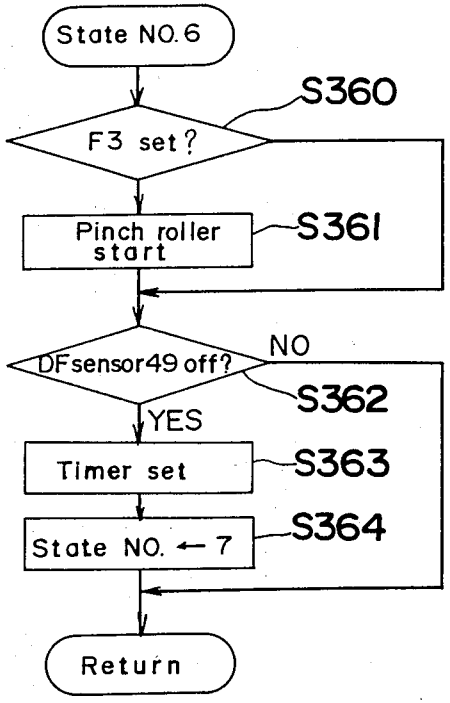

In FIG. 18*g*, if the flag F3 representing the copy with the magnification out of the available magnification limit, the pinch rollers are started in the step S361 so as to feed the copied paper to the platform 52.

In the step S362, the discharging operation of the original is started, and when the original is passes the sensor 48, the timer is set in the step S363 and the state of number is made "7". The timer is set to such a period from a time when the rear edge of the copied paper passes the DF discharging sensor 48 to another time when the original is completely discharged.

Figure 18I:
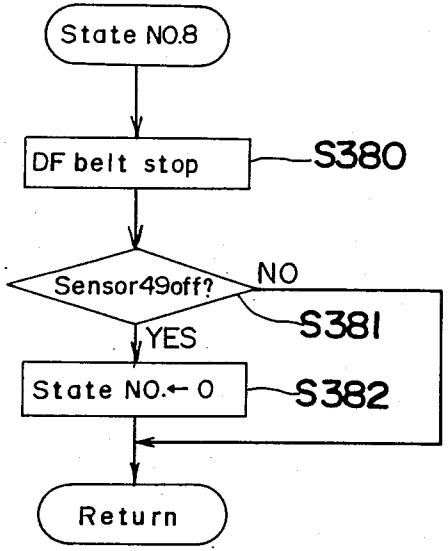
Figure 18H:
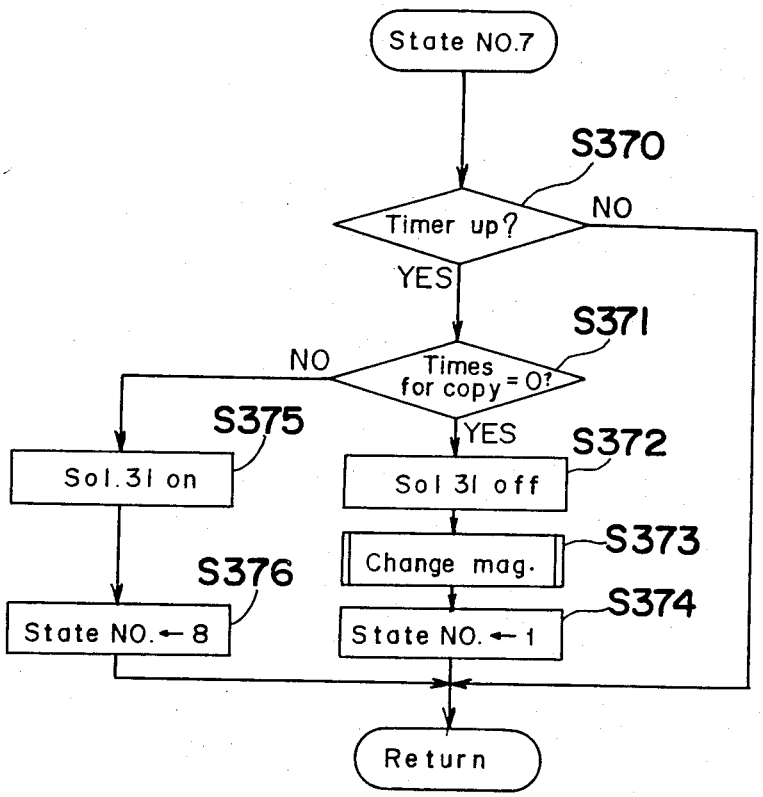

In FIG. 18*h*, when the timer set in the state NO. 6 finishes to count the predetermined period, the process goes to the step S371 from the step S370. In the step S371, the number of time for copying is detected and when the number of times for copying is not 0, that is in case the present copy is not the final time of the copy with the magnification out of the available magnification limit, the process goes to the step S372. In the step S372, the solenoid 31 of the changeover tip 33 is turned off so as to feed the subsequent copied paper to the platform 52.

The step S373 is a subroutine, which is shown in FIG. 19 in detail, for setting the magnification value data for the next copy.

In the step S374, the state number is returned to "1" for repeating the above mentioned operation.

On the other hand, if it is detected that the number of times for copying is 0, the process goes to the step S375 so as to turn the solenoid 31 on to change the changeover tip 33 to feed the next copied paper to the top bin of the sorter tray 140.

In the step S376, the state number is changed to number 8.

In FIG. 18*i*, in the step S380, the DF belt 40 is stopped since the original is completely discharged, then the process advances to the step S381 to determine whether the final copy paper passes the discharging sensor 49. With YES in the step S381, the process goes to the step S382 to make the state number "0" to cause the copying machine to be in "ready for copy" condition.

Figure 19A:
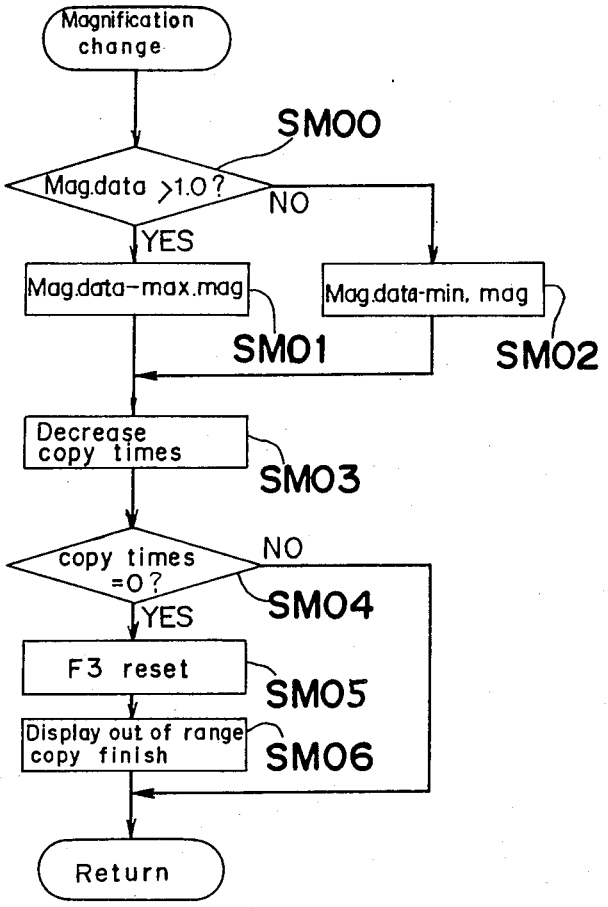

Referring to FIG. 19*a* which shows the changing process of the magnification shown in the step S373 of FIG. 18*h*, in the step SM00, when the desired magnification is more than 1.000, as the magnification value, the maximum available magnification value in the copying machine is set in the copying machine in the step SM01. To the contrary, when the desired magnification is less than 1.000, as the magnification value, the minimum available magnification value is set in the copying machine in the step SM02. Then in the step SM03, the number of times for copy with the magnification out of the available magnification limit is decreased by 1. In the step SM04, it is determined whether or not the number of times for copy is 0. In case the number of times for copy is 0, that is the copy with the magnification out of the available magnification limit is finished, the flag F3 is reset in the step SM05 and the finish of the copy is displayed in the step SM06.

Figure 19B:
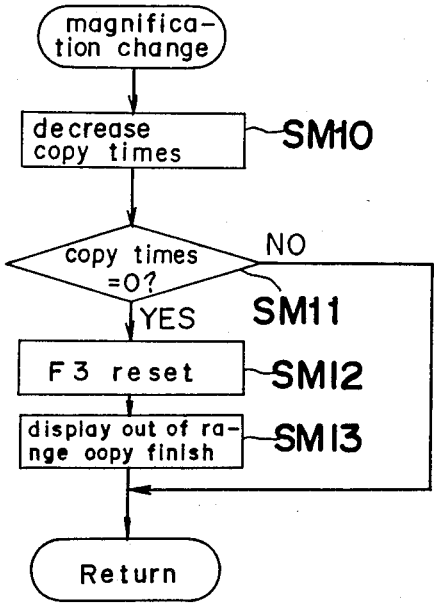

The uniform magnification values for each copy time calculated in the process shown in FIG. 7 can be applicable to the magnification values in the process shown in FIG. 19*a*. In this embodiment there is no need to change the magnification values for each copy time in the process shown in FIG. 19*a*. Thus, as shown in FIG. 19*b*, the number of times for copy is decreased in the step SM11 and when the number of times for copying becomes 0, that is at the final copy in the copy with the magnification out of the available magnification limit, the flag F3 is reset in the step SM12. Then the copy is finished in the step SM12 and this finish of the copy is displayed in the step SN13.

Figure 20:
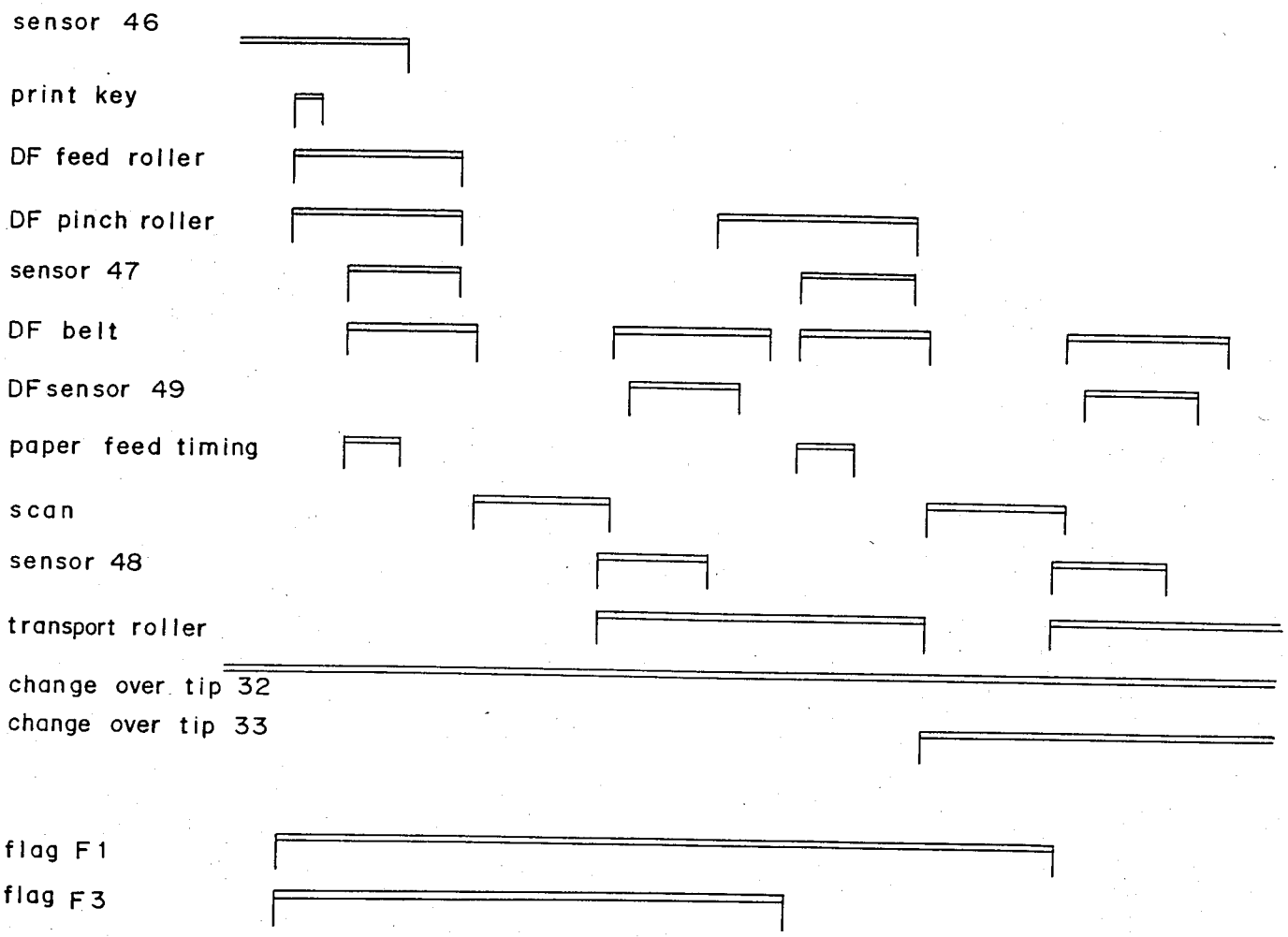
FIG. 20 is a time chart showing the essential operations performed in the copying machine shown in FIGS. 13A and 13B.

FIG. 20 shows a time chart for the copy with the magnification out of the available magnification limit in which the number of times for copy is 2.

When the source original is put on the original feeder 43, the sensor 46 senses the original. In this state, by depressing the print key 71, the original can be entered in the original feeding device by the rollers 38. When the leading edge of the original reaches the paper sensor 47 and is detected by the sensor 47. Then the original feeding belt 40 starts and the original is fed to the platform 52. When the original reaches the predetermined position, the original feeding belt is stopped.

On the other hand, when the leading edge of the original reaches the paper sensor 47, the paper with the optimum size can be fed if the optimum size selection mode is set.

When the original is set in position, the scan by the optical system is started. When the copy paper on which the image of the original is transferred and fixed reaches the discharging sensor 49, the transfer roller 13*b*, intermediate pinch rollers 13*c* and pinch rollers 37 are operated for further feeding the copy paper.

When the exposure is completed, the DF belt 40 is started for discharging the original. If a sufficient time is lapsed after the original discharging sensor 48 senses the original, the DF belt 40 is stopped.

At the timing when the copy paper passes the sensor 49, if the flag F3 representing the copy with the magnification out of the available magnification limit is set, the paper feeding pinch roller 38 is started again so as to cause the present copy paper to be transported to the platform 52. The lens 24 is displaced to the position for enabling the magnification necessary in the subsequent copy.

When the leading edge of the copy paper reaches the sensor 47, the DF belt 40 is started. At the paper feeding timing, the optimum paper size is decided and the paper is selected.

By a process similar to the first time copy operation, the original which is the magnified copy is scanned and the copy process is performed.

When the final copy, which is in the present example the second time copy, is completed, the solenoid 31 is turned on and the the final copy is transported to the top bin of the sorter tray 140.

The copy operation mentioned above may be applied to a multicopy system.

Although the magnification value is automatically set in the copying machine in the above mentioned embodiments, the necessary magnification values may be merely displayed and the magnification values may be set in the copying machine by the operator.

Furthermore, although in the embodiments, the magnification is changed with 1/1000 unit, the magnification may be steplessly changed. Also the present invention may be applied to the copying machine in which the unit of the change of the magnification is rough such as 1/100 or 1/10 unit. In this case, the magnification is the approximate value. For example, assuming that the desired magnification is 2.3 times, and the magnification can be changed with 1/10 unit, by copying the original three times with the magnification value of 1.3, a copy magnified by 2.2 times can be obtained.

What is claimed is:

1. A copying machine with a variable magnification capability and a predetermined range of magnification values which comprises:

means for entering copying magnification data including magnification data out of the said predetermined range, means for calculating a number of copying operations for obtaining a copy with said entered magnification, when said entered magnification is out of the predetermined range, by repeating the copy operation of said number, each time using an original which is a previously copied material magnified with a magnification within said predetermined range, and means for displaying said calculated number of copying operations.

2. The copying machine according to claim 1, wherein said calculating means divide the entered magnification data by a predetermined magnification value within said range and obtaining said number of copying operations by repeating division until the quotient of the division is within the said predetermined range.

3. The copying machine according to claim 2, wherein said predetermined magnification value is the maximum magnification within said predetermined range in case the entered magnification data is larger than the maximum magnification and said predetermined magnification value is the minimum magnification within said predetermined range in case the entered magnification data is smaller than the minimum magnification.

4. The copying machine according to claim 3, further comprising means for setting the magnification value, said setting means being operable to change the set magnification from the quotient to the maximum magnification or minimum magnification which is used as the divisor or vice versa in the process of the plurality of copying operations.

5. The copying machine according to claim 1, further comprising means for calculating an average magnification common to each of the copy operations based on the displayed number of copy operations and the entered magnification data, and means for setting the magnification to the average magnification.

6. The copying machine according to claim 1, wherein said display means displays the number of copying operations decreasing 1 every time one copy is performed.

7. A copying machine according to claim 6 further comprising means for terminating the copy operation and the display of said number at the time said number becomes "0".

8. A copying machine according to claim 1 further comprising means for indicating that the calculated number is in excess of a predetermined number.

9. A copying machine according to claim 8, wherein said indicating means indicates the excess by flickering the displayed number.

10. A copying machine with a variable magnification capability and a predetermined range of magnification which comprises:

means for entering a desired magnification data including a magnification out of said predetermined range, means for calculating a number of copying operations for obtaining a copy with said entered magnification, when said entered magnification is out of the predetermined range, by repeating the copy operation of said number, each time using an original which is a copied material magnified with a magnification within said predetermined range, means for positioning each material at an original platform, means for transporting said materials to said positioning means, and control means for operating said transporting means with said number of copying operations when said entered magnification data is out of the predetermined range.

11. The copying machine according to claim 10, wherein said transporting means contains switch means for delivering said materials either to the positioning means or to the exterior of the copying machine and said control means controls said switch means.

12. The copying machine according to claim 10, further comprises means for automatically setting each magnification value each time said material is made so that a copy with said entered magnification can be obtained.

13. The copying machine according to claim 12, further comprises means for calculating the same magnification value for each time that each of the copy materials is made for obtaining a copy with the entered magnification and said setting means sets said same magnification value.

14. The copying machine according to claim 12, wherein said calculating means divide the entered magnification data by a predetermined magnification value within said range and obtaining said number of copying operations by repeating the division until the quotient of the division is within the said predetermined range.

15. The copying machine according to claim 14, wherein said predetermined magnification value is the maximum magnification within said predetermined range in case the entered magnification data is larger than the maximum magnification and said predetermined magnification value is the minimum magnification within said predetermined range in case the entered magnification data is smaller than the minimum magnification.

16. The copying machine according to claim 15, wherein said setting means changes the magnification value from the quotient of the division to a divisor or vice versa in the process of a series of copies for obtaining a copy with said entered magnification.

17. The copying machine according to claim 10, further comprises means for displaying said number of copying operations.

18. The copying machine according to claim 17, wherein said display means displays the number of copying operations decreasing 1 every time one copy is performed.

19. The copying machine according to claim 10, wherein said positioning means is a document handling device for automatically positioning a document entered therein onto the original platform and for discharging the document after completion of each copy operation and said document handling device is linked up with said transporting means at a position prior to the original platform.

20. The copying machine according to claim 19, wherein said document handling device has a size detector for detecting a size of the document positioned onto the original platform.

21. The copying machine according to claim 20 further comprising a plurality of paper feed stations which store the copy papers with different sizes from each other and means for automatically selecting one paper feed station in which the copy papers with optimum size are stored in accordance with the detected size of the document and the magnification used at each copy operation.

22. A copying machine with a variable magnification capability and a predetermined range of magnification, which comprises:

means for entering a desired magnification data including a magnification out of the predetermined range;

means, when the entered magnification is out of the range, for calculating a number of copy operations for obtaining a copy with the entered magnification by repeating the copy operatons of said number each time using an original which is a copied material magnified with a magnification within the range;

means for establishing a magnification to be used for each of the copy operations;

first display means for displaying the calculated number of copy operations, and second display means for displaying the established magnification.

23. The copying machine according to claim 22, wherein said first display means further indicates that the calculated number is in excess of a predetermined number.

24. The copying machine according to claim 23, wherein said first display means indicates the excess by flickering the displayed number.

25. The copying machine according to claim 22 further comprising means for terminating the displays of the first and second display means when all copy operations to be repeated are completed.

26. The copying machine according to claim 22, wherein said first display means displays a multiple copy number at an ordinary copy mode.

27. The copying machine according to claim 26, wherein said first display means displays the number of copy operations and the multiple copy number in different form with each other.

28. A copying machine with a variable magnification capability and a predetermined range of magnification which comprises:

means for entering a desired magnification data including a magnification out of the predetermined range;

means, when the entered magnification is out of the range, for repeating a plurality of copy operations each time using an original which is a copied material magnified with a magnification within the range to obtain a copy with the entered magnification;

means for establishing a magnification to be used for each of the copying operations, and means for displaying the established magnification.

29. The copying machine according to claim 28, wherein said establishing means divides the entered magnification by a predetermined magnification within said range and repeats the division until the quotient of the division is within said range.

30. The copying machine according to claim 29, wherein said predetermined magnification is the maximum magnification within said range in case the entered magnification is larger than the maximum magnification and said predetermined magnification is the minimum magnification within said range in case the entered magnification is smaller than the minimum magnification.

31. The copying machine according to claim 28, wherein said establishing means calculates an average magnification which is within said range and common to each of the copy operations to be repeated based on the entered magnification and a number of copy operations to be repeated.

* * * * *